US009835981B2

(12) United States Patent
Josiah et al.

(10) Patent No.: US 9,835,981 B2
(45) Date of Patent: Dec. 5, 2017

(54) METHOD AND SYSTEM FOR CONVERTING A TONER CARTRIDGE PRINTER TO A METALLIC, CLEAR FLUORESCENT, OR LIGHT TONER PRINTER

(71) Applicant: UI Technologies, Inc., Las Vegas, NV (US)

(72) Inventors: Michael Raymond Josiah, North Patchogue, NY (US); Joseph Dovi, Lake Grove, NY (US)

(73) Assignee: UI Technologies, Inc., Las Vegas, NV (US)

( * ) Notice: Subject to any disclaimer, the term of this patent is extended or adjusted under 35 U.S.C. 154(b) by 0 days.

(21) Appl. No.: 15/286,875

(22) Filed: Oct. 6, 2016

(65) Prior Publication Data

US 2017/0023884 A1 Jan. 26, 2017

Related U.S. Application Data

(63) Continuation-in-part of application No. 14/879,548, filed on Oct. 9, 2015, now Pat. No. 9,488,932, which (Continued)

(51) Int. Cl.

| | |
|---|---|
| ***G03G 15/00*** | (2006.01) |
| ***G03G 15/08*** | (2006.01) |
| ***G03G 15/01*** | (2006.01) |

(52) U.S. Cl.

CPC ..... *G03G 15/0894* (2013.01); *G03G 15/0121* (2013.01); *G03G 15/0178* (2013.01); (Continued)

(58) Field of Classification Search

CPC ..... G03G 15/6585; G03G 15/0121; G03G 15/556; G03G 15/0863; G03G 15/0894; G03G 15/0178

See application file for complete search history.

(56) References Cited

U.S. PATENT DOCUMENTS

| | | | |
|---|---|---|---|
| 4,630,076 | A | 12/1986 | Yoshimura |
| 4,943,506 | A | 7/1990 | Demizu et al. |

(Continued)

FOREIGN PATENT DOCUMENTS

| | | |
|---|---|---|
| EP | 0280378 | 3/1995 |
| WO | 2014206673 | 12/2014 |

OTHER PUBLICATIONS

Robert-Bosch; Digital Transfer Media for Printers with White Toner; website; Oct. 29, 2014; 8 pages; Forever GmbH Digital Transfer Applications Technology; Heddesheim, Germany; http://www.seri-deco.fi/files/FOREVER%20No-Cut_white%20toner%20flyer.pdf.

(Continued)

*Primary Examiner* — Walter L Lindsay, Jr.

*Assistant Examiner* — Jessica L Eley

(74) *Attorney, Agent, or Firm* — Hankin Patent Law, APC; Kevin Schraven; Lindsey Auerbach

(57) ABSTRACT

Method and system for converting a toner cartridge printer to a white, clear, metallic or light toner printer. The method may comprise the steps: providing a printer having one or more toner cartridges; removing at least one of the one or more toner cartridges; disassembling the one or more removed toner cartridges; cleaning the one or more removed toner cartridges; filling the one or more removed toner cartridges with a white, clear, metallic or light toner; and installing the one or more removed white, clear, metallic or light toner cartridges into the printer.

23 Claims, 13 Drawing Sheets

Related U.S. Application Data is a continuation-in-part of application No. 14/731,785, filed on Jun. 5, 2015, now Pat. No. 9,383,684.

(52) U.S. Cl.
CPC ..... *G03G 15/6585* (2013.01); *G03G 15/0863* (2013.01); *G03G 15/0867* (2013.01); *G03G 2215/00987* (2013.01)

(56) References Cited

U.S. PATENT DOCUMENTS

| | | | | |
|---|---|---|---|---|
| 5,223,906 | A | 6/1993 | Harris | |
| 5,367,327 | A | 11/1994 | Harris | |
| 6,114,077 | A | 9/2000 | Voets et al. | |
| 6,203,953 | B1 | 3/2001 | Dalal | |
| 6,249,655 | B1 | 6/2001 | Baek et al. | |
| 6,535,712 | B2 | 3/2003 | Richards | |
| 6,640,843 | B2 | 11/2003 | Lee | |
| 6,769,766 | B2 | 8/2004 | Suzuki et al. | |
| 6,975,428 | B1 | 12/2005 | Ernst | |
| 7,061,503 | B2 | 6/2006 | Newman | |
| 7,134,749 | B2 | 11/2006 | Ben-Zer et al. | |
| 7,261,390 | B2 | 8/2007 | Nishino | |
| 7,717,532 | B2 | 5/2010 | Kroon et al. | |
| 8,205,981 | B1 | 6/2012 | Marino et al. | |
| 8,298,737 | B2 | 10/2012 | Kadokura | |
| 8,348,399 | B2 | 1/2013 | Gengrinovich | |
| 8,351,100 | B2 | 1/2013 | Mestha et al. | |
| 8,599,436 | B2 | 12/2013 | Sano et al. | |
| 8,728,696 | B2 | 5/2014 | Yamada | |
| 8,735,320 | B2 | 5/2014 | La Costa | |
| 8,784,508 | B2 | 7/2014 | Ellis | |
| 8,851,641 | B2 | 10/2014 | Kamiyama | |
| 2004/0037573 | A1* | 2/2004 | Hirota | G03G 15/0121 399/12 |
| 2004/0252173 | A1 | 12/2004 | Ben-Zur et al. | |
| 2005/0264632 | A1 | 12/2005 | Glass et al. | |
| 2006/0034509 | A1 | 2/2006 | Lu et al. | |
| 2006/0162586 | A1 | 7/2006 | Fresener et al. | |
| 2008/0218539 | A1 | 9/2008 | Hill et al. | |
| 2008/0292332 | A1 | 11/2008 | Okano | |
| 2009/0040249 | A1 | 2/2009 | Wouters | |
| 2014/0037307 | A1* | 2/2010 | Kuo | G03G 15/6585 399/40 |
| 2013/0017480 | A1* | 1/2013 | Suzuki | G03G 9/0804 430/105 |
| 2013/0039675 | A1* | 2/2013 | Holmes | G03G 15/0894 399/109 |
| 2013/0108345 | A1* | 5/2013 | Yamamoto | G03G 15/5087 400/76 |
| 2013/0113854 | A1 | 5/2013 | Iwata | |
| 2013/0235398 | A1 | 9/2013 | Bhatti et al. | |
| 2013/0308985 | A1 | 11/2013 | Tae Soo Kim | |
| 2013/0330522 | A1 | 12/2013 | Suzuki et al. | |
| 2014/0292855 | A1 | 8/2014 | Chang | |

OTHER PUBLICATIONS

Anthony Dinezza; Can a Printer Print White Color; website forum; Apr. 15, 2014; 3 pages; http://superuser.com/questions/663316/can-a-printer-print-white-color.

T-Shirt Forums; Okidata Laser with White Toner; website forum; Jan. 4, 2013; 7 pages; http://www.t-shirtforums.com/laser-heat-transfer-paper/t209046.html.

Top Useful Solutions; DIY White Toner Laser Printer; website forum; Mar. 20, 2015; 4 pages; http://topusefulsolutions.com/10813/diy-white-toner-laser-printer.

Heat Press Nation; White Toner; website; 5 pages; Brea, California; http://www.heatpressnation.com/catalogsearch/result/?q=white+toner&x=0&y=0.

Inkfilling; White Toner; website forum; 2 pages; Irwindale, California; https://www.inkfilling.com/inquiries/thread_1933_html.

Alibaba; White Toner; website; Feb. 9, 2016; 2 pages; China; http://sourcing.alibaba.com/rfq_search_list.htm?fsb=y&IndexArea=rfq_en&CatId=&SearchText=white+toner.

Superuser; What will happen if i put colored toner in Black white laser printer cartridge; website forum; Jan. 20, 2010; 2 pages; http://superuser.com/questions/98147/what-will-happen-if-i-putcolored-toner-in-black-white-laser-printer-cartridge.

Superuser; Can I refill monochrome laser printer cartridge with color powder; website forum; Jan. 3, 2015; 2 pages; http://superuser.com/questions/860019/can-i-refill-monochrome-laserprinter-cartridge-with-color-powder.

Denis Cormier, et al.; Experiments In Layered Electro-Photographic Printing; manuscript; 7 pages; North Carolina State University; Raleigh, North Carolina; http://sffsymposium.engr.utexas.edu/Manuscripts/2000/2000-33-Cormier.pdf.

Graphics One; OKI pro920WT White Toner Solution; catalog; 2 pages; http://www.graphicsone.com/stage/media/catalog/product/PDFs/920%20WT%20Quick%20FAQs.pdf.

Wikipedia; Toner refill; website; Apr. 29, 2015; 3 pages; http://en.wikipedia.org/wiki/Toner_refill.

UNI-KIT; Toner Refill Instructions; manual; 142 pages; Easy Group; http://www.refillinstructions.com/tonerrefillinstructions.pdf.

GCTECH; 4 pack toner refill kit; website; Nov. 12, 2008; 6 pages; Amazon; http://www.amazon.com/Refill-LaserJet-2605DTN-Cartridges-INCLUDES/dp/B001L1A1DS.

Florent Pellegrin; Refilling method for ink jet cartridges; manual; 2007; 252 pages; Thailand; http://www.refillinstructions.com/GeneralRefill.pdf.

Walmart; Ink Refill Kit; website; 4 pages; http://www.walmart.com/c/ep/ink-refill-kit.

Alibaba; White Ink Refill; website; 8 pages; China; http://www.alibaba.com/showroom/white-ink-refill.html.

Print Country; Printer Ink Cartridges Refill Kit Troubleshooting; website; Lihua, Hawaii; 6 pages; http://www.printcountry.com/faq-troubleshooting-refill-kits.asp.

Coldesi Colman; Viper DTG Printer Training Videos—Filling Machine With Ink; video; Mar. 7, 2013; https://www.youtube.com/watch?v=sLyN8fCoy9Q.

Pantograms; Make More Money with our Stitch-n-Print Solutions Combining Embroidery With White Toner Laser Printers; website article; Tampa, Florida; 5 pages; http://www.pantograms.com/stitchnprintembroideryandheattransfers.asp.

Automatic Transfer, Inc.; White Sublimation Laser Toner; website; Alpha, New Jersey; 3 pages; http://www.atttransfer.com/whitetoner.html.

The Recycler; OKI's white toner technology wins awards; website article; Mar. 22, 2013; 2 pages; http://www.therecycler.com/posts/okis-white-toner-technology-winsawards/.

Print Planet; The 5th Toner; website forum; Apr. 6, 2012; 2 pages; http://printplanet.com/forums/digital-printing-discussion/28580-5thtoner.

Durst Tau 150 8C; High Speed Digital UV Inkject Label Press; YouTube video; Dec. 21, 2011; https://www.youtube.com/watch?v=va8KwofWDus.

Epson; WT7900 White Based Printing Technology; website; https://www.epson.com/cgibin/Store/jsp/Pro/SeriesStylusProWT7900/Overview.do?UseCookie=yes.

Oce; Oce White Ink Technology; website; Canon; http://global.oce.com/technologies/white-ink-technology.aspx.

Smartpress; White Ink Printing; website; http://smartpress.com/pages/white-ink-printing.

Mark Ritchie; UV White Inkjet Inks for Single-Pass Label Applications; brochure; Jan. 4, 2015; Xaar; http://www.xaar.com/en/MediaDocuments/UV-inks-white-paper.pdf.

Tshirt Forum; OKI Tabloid Printer with White Toner; website forum; May 18, 2013; http://www.t-shirtforums.com/printers-inks-inkjet-laser-transfers/t151402-12.html.

Korean Intellectual Property Office, International Search Report, dated Aug. 31, 2016, 3 pages.

(56) References Cited

OTHER PUBLICATIONS

Korean Intellectual Property Office, Written Opinion of the International Searching Authority, Aug. 31, 2016, 4 pages.

* cited by examiner

METHOD AND SYSTEM FOR CONVERTING A TONER CARTRIDGE PRINTER TO A METALLIC, CLEAR FLUORESCENT, OR LIGHT TONER PRINTER

CROSS-REFERENCE TO RELATED APPLICATIONS

This Patent Application is a Continuation-in-Part of U.S. Non-Provisional patent application Ser. No. 14/879,548, filed on Oct. 9, 2015, titled "Method And System For Converting A Toner Cartridge Printer To A White, Clear, Or Fluorescent Toner Printer", by inventors Michael Raymond Josiah and Joseph Dovi, the contents of which are expressly incorporated herein by this reference as though set forth in their entirety and to which priority is claimed. U.S. Non-Provisional patent application Ser. No. 14/879,548 is a Continuation-in-Part of U.S. Non-Provisional patent application Ser. No. 14/731,785, filed on Jun. 5, 2015, titled "Method and System for Converting a Toner Cartridge Printer to a White Toner Printer," by inventors Michael Raymond Josiah and Joseph Dovi, the contents of which are expressly incorporated herein by this reference as though set forth in their entirety and to which priority is claimed.

FIELD OF USE

The present disclosure relates generally to printer cartridge replacement. More specifically, this disclosure relates to methods and systems of converting a standard toner cartridge printer to a printer that prints with white, metallic, fluorescent, or light toner.

BACKGROUND

Traditional Cyan (C), Magenta (M), Yellow (Y), and Black (K) (or CMYK) laser or Light Emitting Diode (LED) type printers come standard with Cyan, Magenta, Yellow, and Black toner and/or drum cartridges. However, traditional black toner printers and CMYK toner printers are generally unable to print in white, metallic, fluorescent, or light toner as the foreground or as the background, as these printers lack the appropriate toner and/or drum cartridges and the appropriate raster image processor (RIP) software for printing cartridge re-mapping.

Printing in white toner is feasible through the use of white toner printers and would generally allow a user to print on dark or clear media, but white media printers are dedicated to CMYW only where white is always a top color. This system does not allow printing on clear or dark media and may require the user to buy an entirely new printer. Printers that print both in white and color are CMYKW printers with a minimum of five toner printing cartridges and white is always the last cartridge which does not allow a layer of white to be put down first as a background color.

Additionally, traditional CMYK printers have only been able to approximate metallic tones by blending CMYK colors. Metallic colors, such as gold, copper, brass, bronze, platinum, chrome, silver, and metallic tones of other colors, such as magenta, yellow, and cyan, can be done not using traditional printers, including by offset printing, silkscreen printing, and hot foil stamping, etc. Each of these has its own strengths, but none of them is really suited to the needs of on-demand printing. For example, in offset printing, each spot color requires its own plate, the production of which incurs cost. In silk screen printing and hot foil stamping also, plates and molds need to be made, requiring professional expertise and making the cost of each print that much more expensive, so that these technologies are not easy to apply unless a print run is of a certain size.

Similarly, printing light colors, such as light magenta or light cyan, is traditionally achieved using different combinations of the primary CMYK colors. However, since the primary CMYK colors are designed and tailored for printing bright, vivid, and high chroma graphics on plain paper these colors, in general, are not lightfast. Generally, these colors do not provide a "true" photographic lightfastness especially in the lower portion of the tone scales. Thus, the challenge remains to further improve the image quality and lightfastness of prints without sacrificing performance and reliability.

Thus, there is a need for a system and method for converting or retrofitting a standard CMYK (four cartridge) toner printer to print using white, metallic, fluorescent, or light toner and wherein the layer of white, metallic, fluorescent, or light toner may be a background or foreground color.

SUMMARY OF EMBODIMENTS

To minimize the limitations in the cited references, and to minimize other limitations that will become apparent upon reading and understanding the present specification, the toner printer converting, refilling, and refurbishment systems and methods disclosed herein preferably allow a user to convert a standard printer into one that prints using white, metallic gold, metallic silver, light magenta, or light cyan toner.

In various embodiments, the methods and systems may be used to convert a traditional toner cartridge(s) and/or drum (s) printing machine to a printing machine that prints white, metallic, or light from one or more of the toner cartridge(s).

In a preferred embodiment, a standard toner cartridge printer is converted by replacing the color or black toner printing cartridge in the first toner printing cartridge position, which allows the printer to print white, metallic, or light as a background color prior to printing the other colors.

In another embodiment, a standard toner cartridge printer is converted by replacing the color or black toner printing cartridge in the last toner printing cartridge position, which allows the printer to print white, metallic, or light as a foreground color.

In the embodiments immediately above, the addition of the white, metallic, fluorescent, or light toner may be accompanied by cartridge re-mapping using RIP software. The RIP software allows a user to set how much white, metallic, fluorescent, or light toner should be added to maximize the look of the finished print job.

In one embodiment, the cartridge re-mapping is used to allow a white, metallic, fluorescent, or light toner printing cartridge to be put in the "K" (black) slot (which may be the first slot in the printer) of a CYMK printer and the CYM cartridges are all in their original slots. In this manner, a layer of white, metallic, or light may be put down, on top of which a full color layer may be printed, and may be used on clear and dark media.

In another embodiment, the cyan cartridge is replaced by a white, metallic, fluorescent, or light toner printing cartridge and the black cartridge is replaced with a cyan cartridge. In this manner, white, metallic, or light may be a foreground layer or be printed concurrently with the other colors. The RIP software allows the printer to print the color, black, and white/metallic/light in a layered or pass format.

In one embodiment the printing cartridge integrated circuits (chips) may be swapped along with the toner printing cartridges, but the RIP software is configured to ensure that the correct colors print regardless of which slot the colors are placed.

The RIP software may allow or feature color rasterization, which enables the printer to use less toner by selectively removing pixels to use less toner. This feature gives a nicer feel and ads more durability to the finished product.

In one embodiment of the conversion method, a CMYK toner printer may be converted to CMYW or M CMYW, wherein the M stands for Metallic, and wherein the printing cartridges may be placed in any order within the printer. The RIP software may be used to map the final placement of each toner color in the CMYW or M CMYW, wherein W may be white, or metallic.

In one embodiment, a CMYW printer may be converted to any combination of metallic, light, or standard colors.

One embodiment may be a method of converting a printer to print with white toner, comprising the steps: providing a toner printer. The toner printer may have four printing cartridges and may comprise a black toner printing cartridge, a cyan toner printing cartridge, a magenta toner printing cartridge, and a yellow toner printing cartridge. The black toner printing cartridge may be in a first position of the toner printer. The black toner may be removed from the printing cartridge from the toner printer. A white toner printing cartridge may be provided. The white toner printing cartridge may be installed into the first position of the toner printer. A raster image processor (RIP) software may be provided for printing cartridge remapping such that a first layer using only the white toner printing cartridge may be printed, and then a second layer may be printed over the white layer in one pass. The printer may be a laser toner printer. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. The installing of the white toner printing cartridge in the first position may allow the printer to print the first layer using only the white toner printing cartridge. Additionally, the provided white toner printing cartridge may comprise: disassembling the removed black toner printing cartridge; emptying and cleaning the removed black toner printing cartridge, such that an empty printing cartridge may be created; and filling the empty printing cartridge with a white toner.

Another embodiment may be a method of converting a printer to print with white toner, comprising the step: providing a toner printer. The toner printer may have four printing cartridges. The four printing cartridges may comprise a black toner printing cartridge, a cyan toner printing cartridge, a magenta toner printing cartridge, and a yellow toner printing cartridge. The black toner printing cartridge may be in a first position of the toner printer. The black toner printing cartridge may be removed from the toner printer. A cyan toner printing cartridge may be in a fourth position of the toner printer. The cyan toner printing cartridge may be removed from the toner printer. A white toner printing cartridge may be provided. A cyan toner printing cartridge may be installed into the first position of the toner printer. The white toner printing cartridge may be installed into the fourth position of the toner printer. Raster image processor (RIP) software may provide for printing cartridge remapping. A first layer not using the white toner printing cartridge may be printed, and then a second layer may be printed over the first layer. The second layer may print only using the white toner printing cartridge. A layer using all four of the four toner printing cartridges may be printed. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. Additionally, the provided white toner printing cartridge may comprise: disassembling the removed black toner printing cartridge; emptying and cleaning the removed black toner printing cartridge, such that an empty printing cartridge may be created; and filling the empty printing cartridge with a white toner.

One embodiment may be a method of converting a printer to print with metallic toner, comprising the step: providing a toner printer. The toner printer may have four printing cartridges and may comprise a black toner printing cartridge, a cyan toner printing cartridge, a magenta toner printing cartridge, and a yellow toner printing cartridge. The black toner printing cartridge may be in a first position of the toner printer. The black toner may be removed from the printing cartridge from the toner printer. A metallic toner printing cartridge may be provided. The metallic toner printing cartridge may be installed into the first position of the toner printer. A raster image processor (RIP) software may be provided for printing cartridge remapping such that a first layer using only the metallic toner printing cartridge may be printed, and then a second layer may be printed over the metallic layer in one pass. The printer may be a laser toner printer. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. The installing of the metallic toner printing cartridge in the first position may allow the printer to print the first layer using only the metallic toner printing cartridge. Additionally, the provided metallic toner printing cartridge may comprise: disassembling the removed black toner printing cartridge; emptying and cleaning the removed black toner printing cartridge, such that an empty printing cartridge may be created; and filling the empty printing cartridge with a metallic toner.

Another embodiment may be a method of converting a printer to print with metallic toner, comprising the step: providing a toner printer. The toner printer may have four printing cartridges. The four printing cartridges may comprise a black toner printing cartridge, a cyan toner printing cartridge, a magenta toner printing cartridge, and a yellow toner printing cartridge. The black toner printing cartridge may be in a first position of the toner printer. The black toner printing cartridge may be removed from the toner printer. A cyan toner printing cartridge may be in a fourth position of the toner printer. The cyan toner printing cartridge may be removed from the toner printer. A metallic toner printing cartridge may be provided. A cyan toner printing cartridge may be installed into the first position of the toner printer. The metallic toner printing cartridge may be installed into the fourth position of the toner printer. Raster image processor (RIP) software may provide for printing cartridge remapping. A first layer not using the metallic toner printing cartridge may be printed, and then a second layer may be printed over the first layer. The second layer may print only using the metallic toner printing cartridge. A layer using all four of the four toner printing cartridges may be printed. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. Additionally, the provided metallic toner printing cartridge may comprise: disassembling the removed black toner printing cartridge; emptying and cleaning the removed black toner printing cartridge, such that an empty printing cartridge may be created; and filling the empty printing cartridge with a metallic toner.

One embodiment may be a method of converting a printer to print with light toner, comprising the step: providing a toner printer. The toner printer may have four printing cartridges and may comprise a black toner printing cartridge, a cyan toner printing cartridge, a magenta toner printing cartridge, and a yellow toner printing cartridge. The black toner printing cartridge may be in a first position of the toner printer. The black toner may be removed from the printing cartridge from the toner printer. A light toner printing cartridge may be provided. The light toner printing cartridge may be installed into the first position of the toner printer. A raster image processor (RIP) software may be provided for printing cartridge remapping such that a first layer using only the light toner printing cartridge may be printed, and then a second layer may be printed over the light layer in one pass. The printer may be a laser toner printer. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. The installing of the light toner printing cartridge in the first position may allow the printer to print the first layer using only the light toner printing cartridge. Additionally, the provided light toner printing cartridge may comprise: disassembling the removed black toner printing cartridge; emptying and cleaning the removed black toner printing cartridge, such that an empty printing cartridge may be created; and filling the empty printing cartridge with a light toner.

Another embodiment may be a method of converting a printer to print with light toner, comprising the steps: providing a toner printer. The toner printer may have four printing cartridges. The four printing cartridges may comprise a black toner printing cartridge, a cyan toner printing cartridge, a magenta toner printing cartridge, and a yellow toner printing cartridge. The black toner printing cartridge may be in a first position of the toner printer. The black toner printing cartridge may be removed from the toner printer. A cyan toner printing cartridge may be in a fourth position of the toner printer. The cyan toner printing cartridge may be removed from the toner printer. A light toner printing cartridge may be provided. A cyan toner printing cartridge may be installed into the first position of the toner printer. The light toner printing cartridge may be installed into the fourth position of the toner printer. Raster image processor (RIP) software may provide for printing cartridge remapping. A first layer not using the light toner printing cartridge may be printed, and then a second layer may be printed over the first layer. The second layer may print only using the light toner printing cartridge. A layer using all four of the four toner printing cartridges may be printed. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. Additionally, the provided light toner printing cartridge may comprise: disassembling the removed black toner printing cartridge; emptying and cleaning the removed black toner printing cartridge, such that an empty printing cartridge may be created; and filling the empty printing cartridge with a light toner.

Another embodiment may be a method of converting a printer to print with metallic toner, comprising the steps: providing a toner printer. The toner printer may have four printing cartridges. One or more of the four toner printing cartridges may be removed from the toner printer, such that there may be empty toner printing cartridge position(s). Metallic toner printing cartridge(s) may be provided. Metallic toner printing cartridge(s) may be installed into empty toner printing cartridge(s). Raster image processor (RIP) software may provide for printing cartridge remapping. The CMYK printer may be a CMYW printer. All four of the four toner printing cartridges may be removed and replaced with four metallic toner printing cartridges. The four toner printing cartridges of the printer may comprise four separate drums and four separate toner printing cartridges. The four toner printing cartridges of the printer may comprise four separate toner printing cartridges and one single drum cartridge. The four toner printing cartridges of printer may comprise four combined toner and drum printing cartridges.

Another embodiment may be a method of converting a printer to print with light toner, comprising the steps: providing a toner printer. The toner printer may have four printing cartridges. One or more of the four toner printing cartridges may be removed from the toner printer, such that there may be empty toner printing cartridge position(s). Metallic toner printing cartridge(s) may be provided. Metallic toner printing cartridge(s) may be installed into empty toner printing cartridge(s). Raster image processor (RIP) software may provide for printing cartridge remapping. The CMYK printer may be a CMYW printer. All four of the four toner printing cartridges may be removed and replaced with four metallic toner printing cartridges. The four toner printing cartridges of the printer may comprise four separate drums and four separate toner printing cartridges. The four toner printing cartridges of the printer may comprise four separate toner printing cartridges and one single drum cartridge. The four toner printing cartridges of printer may comprise four combined toner and drum printing cartridges.

Another embodiment of the method may be converting a CMYK printer to print with metallic toner, comprising the steps: providing a CMYK toner printer; wherein the toner printer has four printing cartridges; removing one or more of the four toner printing cartridges from the toner printer, such that there are one or more empty toner printing cartridge positions; providing one or more metallic toner printing cartridges; installing the one or more metallic toner printing cartridges into the one or more empty toner printing cartridges; and providing raster image processor (RIP) software for printing cartridge remapping. The metallic toner may be selected from the group of metallic toners consisting of: gold, copper, brass, bronze, platinum, chrome, silver, metallic magenta, metallic yellow, and metallic cyan. The CMYK printer may be a CMYW printer. All four of the four toner printing cartridges may be removed and replaced with four metallic toner printing cartridges. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges.

Another embodiment of the method may be a method of converting a CMYK printer to print with light toner, comprising the steps: providing a CMYK toner printer; wherein the toner printer has four printing cartridges; removing one or more of the four toner printing cartridges from the toner printer, such that there are one or more empty toner printing cartridge positions; providing one or more light toner printing cartridges; installing the one or more light toner printing cartridges into the one or more empty toner printing cartridges; and providing raster image processor (RIP) software for printing cartridge remapping. The light toner may comprise light magenta or light cyan toner. The CMYK printer may be a CMYW printer. All four of the four toner printing cartridges may be removed and replaced with four light toner printing cartridges. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges.

Another embodiment of the method may be a method of converting a printer to print with clear fluorescent toner, comprising the steps: providing a toner printer; wherein the toner printer has four printing cartridges; wherein the four printing cartridges comprise a black toner printing cartridge, a cyan toner printing cartridge, a magenta toner printing cartridge, and a yellow toner printing cartridge; wherein the black toner printing cartridge is in a first position of the toner printer; removing the black toner printing cartridge from the toner printer; wherein the cyan toner printing cartridge is in a fourth position of the toner printer; removing the cyan toner printing cartridge from the toner printer; providing a clear fluorescent toner printing cartridge; installing the cyan toner printing cartridge into the first position of the toner printer; installing the clear fluorescent toner printing cartridge into the fourth position of the toner printer; providing raster image processor (RIP) software for printing cartridge remapping; and wherein the clear fluorescent toner is only visible under an ultraviolet light. The method may further comprise the steps: printing a first layer not using the clear toner printing cartridge and then printing a second layer over the first layer; wherein the second layer prints only using the clear fluorescent toner printing cartridge. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. The providing of the clear fluorescent toner printing cartridge comprises: disassembling the removed black toner printing cartridge; emptying and cleaning the removed black toner printing cartridge, such that an empty printing cartridge is created; and filling the empty printing cartridge with a clear fluorescent toner.

Another embodiment of the method may be a method of converting a printer to print with white toner comprising the steps: providing a color toner printer; wherein the color toner printer comprises a plurality of drum cartridges and a plurality of toner cartridges; wherein the plurality of toner cartridges comprises a cyan toner cartridge, a yellow toner cartridge, a magenta toner cartridge, and a black toner cartridge; wherein the plurality of drum cartridges comprises a cyan drum cartridge, a yellow drum cartridge, a magenta drum cartridge, and a black drum cartridge; removing the cyan toner cartridge, the magenta toner cartridge, the cyan drum cartridge, and the magenta drum cartridge; disassembling the cyan drum cartridge and the magenta drum cartridge; emptying and cleaning the cyan toner cartridge, the magenta toner cartridge, the cyan drum cartridge, and the magenta drum cartridge; priming the cyan drum cartridge and the magenta drum cartridge with a white toner; filling the cyan toner cartridge and the magenta toner cartridge with the white toner; and installing the white toner filled cartridges and the white toner primed drums into the printer. The method may also comprise refurbishing at least one of the cyan toner cartridge, the magenta toner cartridge, the cyan drum cartridge, and the magenta drum cartridge. The method may also comprise disassembling at least one of the cyan toner cartridge and the magenta toner cartridge. The method may also comprise adjusting one or more printer settings so that the printer prints using the white toner filled cartridges. The one or more printer settings may be set to print 100% Cyan and 100% Magenta in order to print white areas.

Another embodiment of the method may be a method of converting a printer to print with white toner, comprising the steps: providing a color toner printer; wherein the color toner printer comprises a drum cartridge and a plurality of toner cartridges; wherein the plurality of toner cartridges comprises a cyan toner cartridge, a yellow toner cartridge, a magenta toner cartridge, and a black toner cartridge; removing the yellow toner cartridge, the magenta toner cartridge, and the drum cartridge; disassembling the drum cartridge; emptying and cleaning the cyan toner cartridge, the magenta toner cartridge, and the drum cartridge; priming the drum cartridge with a white toner; filling the cyan toner cartridge and the magenta toner cartridge with the white toner; and installing the white toner filled cartridges and the white toner primed drum into the printer. The method may further comprise refurbishing at least one of the cyan toner cartridge, the magenta toner cartridge, and the drum cartridge. The method may further comprise disassembling at least one of the cyan toner cartridge and the magenta toner cartridge. The method may further comprise adjusting one or more printer settings so that the printer prints using the white toner filled cartridges. The one or more printer settings may be set to print 100% Cyan and 100% Magenta in order to print white areas.

Another embodiment of the method may be a method of converting a printer to print with a non-standard toner, comprising the steps: providing a color toner printer; wherein the color toner printer comprises a plurality of drum cartridges and a plurality of toner cartridges; wherein the plurality of toner cartridges comprises a cyan toner cartridge, a yellow toner cartridge, a magenta toner cartridge, and a black toner cartridge; wherein the plurality of drum cartridges comprises a cyan drum cartridge, a yellow drum cartridge, a magenta drum cartridge, and a black drum cartridge; removing the black toner cartridge and the black drum cartridge; providing an empty replacement toner cartridge and an empty replacement drum cartridge; priming the empty replacement drum cartridge with a non-standard toner; filling the empty replacement toner cartridge with the non-standard toner; and installing the non-standard toner filled replacement toner cartridge and the non-standard toner primed drum cartridge into the printer. The empty replacement toner cartridge and the empty replacement drum cartridges may be new. The method may further comprise adjusting one or more printer settings so that the printer prints using the non-standard toner filled cartridge. The one or more printer settings may be set to print at 100% K. The non-standard toner may be selected from the group of non-standard toners consisting of: white, clear, metallic, fluorescent, clear fluorescent, and light toner.

Another embodiment of the method may be a method of converting a printer to print with non-standard toner comprising the steps: providing a monochromatic printer; wherein the monochromatic printer has one or more printing cartridges; providing one or more empty replacement toner and drum cartridges; filling the one or more empty replacement toner and drum cartridges with a non-standard toner; and installing the one or more non-standard toner filled cartridges into the printer. The non-standard toner may be selected from the non-standard toners consisting of: white, clear, metallic, fluorescent, clear fluorescent, or light toner.

Another embodiment may be a method of converting a CMYK printer to print with a non-standard toner, comprising the steps: providing a CMYK toner printer; wherein the CMYK toner printer has four toner printing cartridges, wherein three of the four toner printing cartridges are color printing cartridges comprising a cyan toner printing cartridge, a magenta toner printing cartridge, and a yellow toner printing cartridge; removing one or more of the color toner printing cartridges from the toner printer, such that there are one or more empty toner printing cartridge positions; providing one or more non-standard toner printing cartridges; and installing the one or more non-standard toner printing cartridges into the one or more empty toner printing cartridges. The one or more printer settings may be set to print at 100% K for printing in black. The non-standard toner in the one or more non-standard toner printing cartridges may be selected from the group of non-standard toners consisting of: metallic toner, fluorescent toner, and light toner. All three of the one or more of the color toner printing cartridges may be removed from the toner printer. The method may further comprise providing raster image processor (RIP) software for printing cartridge remapping. The method may further comprise adjusting one or more printer settings so that the printer prints using the one or more non-standard toner filled cartridges. The one or more non-standard toner printing cartridges may be the one or more removed color toner printing cartridges that have been emptied, cleaned, and refilled with at least one of a plurality of non-standard toners. The providing of the one or more non-standard toner printing cartridge may comprise: disassembling the removed one or more of said color toner printing cartridges; emptying and cleaning the removed one or more of said color toner printing cartridges, such that one or more empty printing cartridges are created; and filling the one or more empty printing cartridges with one of a plurality of non-standard toner.

It is an object of the present system and method for converting a standard toner cartridge printer into white, metallic, fluorescent, or light toner printer.

It is an object of the present system to overcome the limitations of the prior art.

It is an object of the present system and method for converting a standard toner cartridge printer into white, metallic, fluorescent, or light toner printer in order to print white, metallic, fluorescent, or light toner as the foreground.

It is an object of the present system and method for converting a standard toner cartridge printer into white, metallic, fluorescent, or light toner printer in order to print white, metallic, fluorescent, or light toner as the background.

It is an object of the present system and method for converting a standard toner cartridge printer into white, metallic, fluorescent, or light toner printer in order to print in layers of colored and/or white, metallic, fluorescent, or light toner.

It is an object of the present system and method for raster image processor software to provide cartridge remapping, which allows the system to print using white, metallic, fluorescent, or light toner from different cartridge positions.

It is an object of the present system and method for raster image processor software to assist in printing white, metallic, fluorescent, or light toner as the foreground and/or background and/or in layers with colored toner.

One embodiment of the system and method may be a Double White Printing:

1. CMYK printer with separate toner and drum cartridges—white for magenta and cyan swap
   Turn off yellow
   Print white through red (½ cyan and ½ magenta), which preferably results in double white printing.

One embodiment of the system and method may be Double White Printing:

1. CMYK printer with a single drum and separate toner cartridges—white for magenta and cyan swap
   Turn off yellow
   Print white through red (½ cyan and ½ magenta), which preferably results in double white printing.

In one embodiment of the system and method may use new empty or recycled empty toner cartridges that have been pre-cleaned and filed with white, metallic, fluorescent, or light toner. In this embodiment the original cartridge(s) to be removed do not have to be cleaned and filed, they can immediately be replaced by a prefilled new or used cartridge.

Other features and advantages inherent in the system and method for converting a standard toner cartridge printer into white, metallic, fluorescent, or light toner printer claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
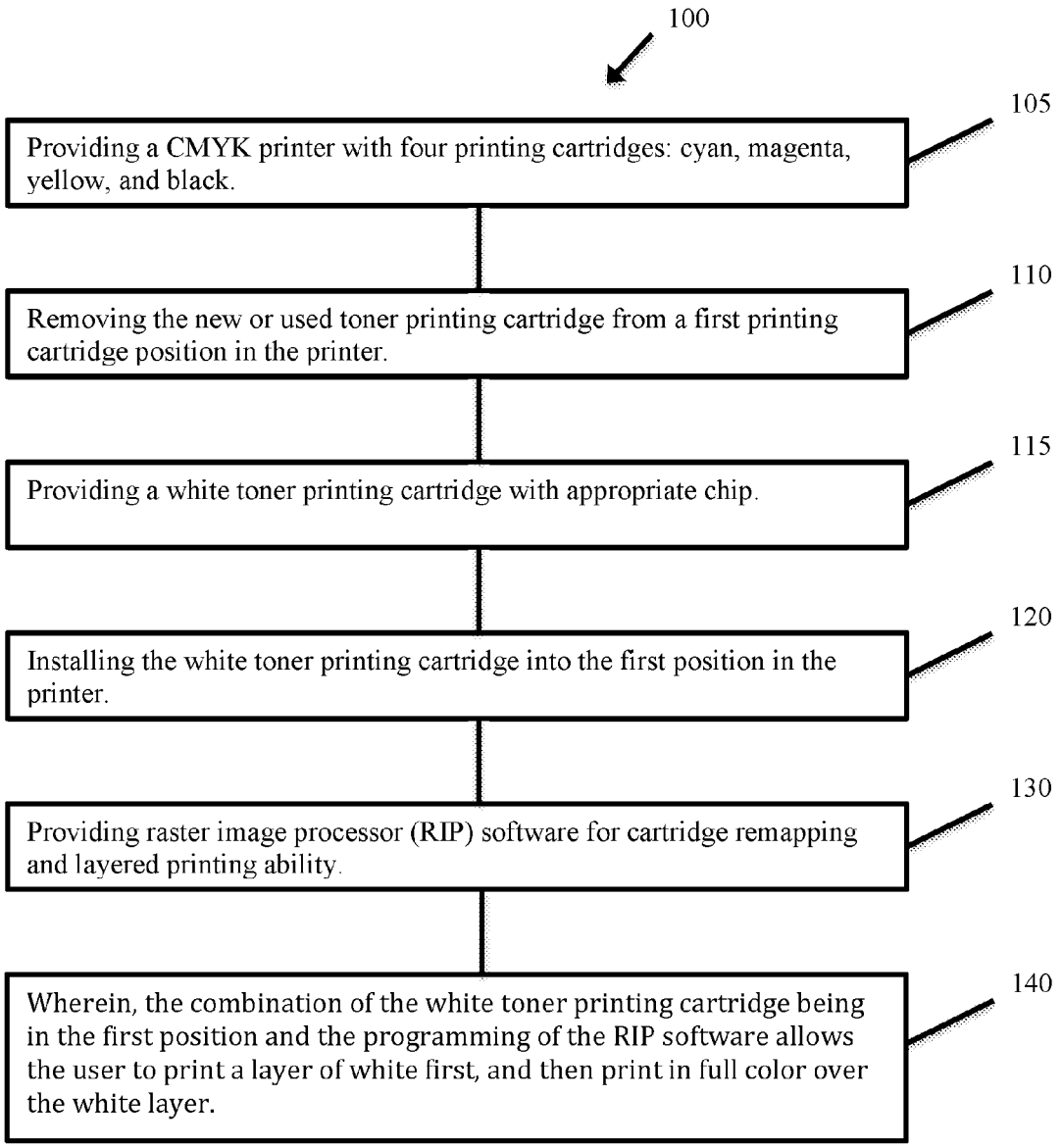
FIG. 1 is a flow block diagram of one embodiment of the method of converting a CMYK printer to print white in the background.

In the following detailed description, numerous specific details are set forth in order to provide a thorough understanding of various aspects of one or more embodiments. However, the one or more embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment of the invention shall not be interpreted to limit the scope of protection.

The present specification discloses a system and method for converting a toner cartridge printer to a white, metallic, fluorescent, or light toner printer. The method and system for converting a toner cartridge printer to a white, metallic, fluorescent, or light toner printer preferably requires no special or dedicated printer drivers.

In the following description, certain terminology is used to describe certain features of one or more embodiments. For purposes of the specification, unless otherwise specified, the term "printing cartridge(s)" generally refers to a toner cartridge, a laser toner cartridge, a LED toner cartridge, a drum cartridge, and/or a combined toner and drum cartridge.

As used herein, the term "toner" generally refers to a powder, particulate, or dry ink that is used in laser printers, printers, and printing machines to form the printed text and images on the medium being printed. Generally, toner particles are melted by the heat of a fuser, and bound to the media.

Regarding a CMYW printer, the W preferably stands for white, but the W in some embodiments may also stand for metallic gold, metallic silver, light magenta, or light cyan.

Regarding a M CMYW printer, the M stands for metallic, wherein the cyan, magenta, yellow, and/or white toner printing cartridges may be a metallic color. Before the present printer conversion method, metallic toner printing cartridges had never been substituted into a CMYK or CMYW printer.

The present method and system for converting a toner cartridge printer to a white, metallic, fluorescent, or light toner printer may allow the conversion of: (1) a conversion of a CMYK machine that has separate toner and drum cartridges; (2) a conversion of a CMYK machine that has separate toner and drum cartridges; and (3) a conversion of a CMYK machine with a single drum and separate toner printing cartridges.

Regarding the conversion of a CMYK machine to a metallic toner printer, one or more of the original toner printing cartridges may be replaced with one or more metallic toner printing cartridges and the RIP software is utilized to map the toner printing cartridge positions to reflect the new metallic toner colors. In one embodiment, the below discussion of white toner printing cartridge conversion is essentially identical, with the exception that a metallic toner printing cartridge is substituted for a white toner printing cartridge.

Regarding the conversion of a CMYK machine to a light toner printer, one or more of the original toner printing cartridges may be replaced with one or more light toner printing cartridges and the RIP software is utilized to map the toner printing cartridge positions to reflect the new light toner colors. In one embodiment, the below discussion of white toner printing cartridge conversion is essentially identical, with the exception that a light toner printing cartridge is substituted for a white toner printing cartridge.

Regarding the conversion of a CMYK machine that has separate toner and drum cartridges, the conversion may comprise replacing one of the color cartridges with a white, metallic, fluorescent, or light toner printing cartridge and replacing the accompanying color drum with a white, metallic, or light drum.

Regarding the conversion of a CMYK machine that has separate toner printing cartridges, but a single drum cartridge, the conversion may comprise replacing one of the color cartridges with a white, metallic, fluorescent, or light toner printing cartridge and cleaning the accompanying drum portion of color toner and priming it with white, metallic, fluorescent, or light toner.

Regarding the conversion of a CMYK machine that has combined toner and drum cartridges, the conversion may comprise replacing one of the combined color cartridges with a combined white, clear, metallic, fluorescent, or light toner printing cartridge.

FIG. 1 is a flow block diagram of one embodiment of the method of converting a CMYK printer to print with white toner in the background. As shown in FIG. 1, the conversion method 100 may comprise providing a CMYK printer with four printing cartridges: cyan, magenta, yellow, and black 105. Preferably, the CMYK printer is a LED printer. In one embodiment the black toner printing cartridge may be in the first printing cartridge position. The method 100 may further comprise removing the black printing cartridge and/or drum cartridge from the printer 110. If there is only one drum cartridge that services all of the printing cartridges, the drum must be cleaned and primed with the clear or white toner. The method 100 may further comprise: providing a white toner printing cartridge and/or drum cartridge 115; installing the white toner and/or drum cartridge into the first slot or position in the CMYK printer 120; and providing raster image processor (RIP) software for printing cartridge remapping 130. Wherein, the combination of the white toner printing cartridge being in the first position and the programming of the RIP software allows the user to print a layer of white first, and then print in full color over the white layer 140. The white toner printing cartridge may be provided by disassembling the removed printing cartridge, emptying and cleaning the removed printing cartridge to create an empty printing cartridge, and then filling the empty printing cartridge with a white toner.

The installation may be of a used or new toner printing cartridge.

Regarding the RIP software, the RIP software utilizes printing cartridge mapping to enable the ability to move, change or swap printing cartridge locations in the printer. This allows white under printing or over printing in a single pass. The RIP software may also add a customizable separate layer of white either on top or underneath the image depending on the cartridge configuration and printing needs. This fully customizable feature in the software (RIP) allows you to completely reconfigure the printer to get almost any desired effect. However, in a preferred embodiment, the white toner background layer may be printed when the white toner is placed in the first printing cartridge position. Additionally, in a preferred embodiment, the white toner foreground layer may be printed when the white toner is place in the last printing cartridge position.

The RIP software may also be configured to allow the user to print in full color, CMY black, and white, such that the white prints with the other colors at the same time in a single layer. Preferably, the single layer is put down in a single pass.

The modified printer may be converted back to a traditional CMYK printer by removing the white toner and/or drum cartridge from the first slot in the CMYK printer and re-installing the black toner printing cartridge and/or drum cartridge (if needed).

Figure 2:
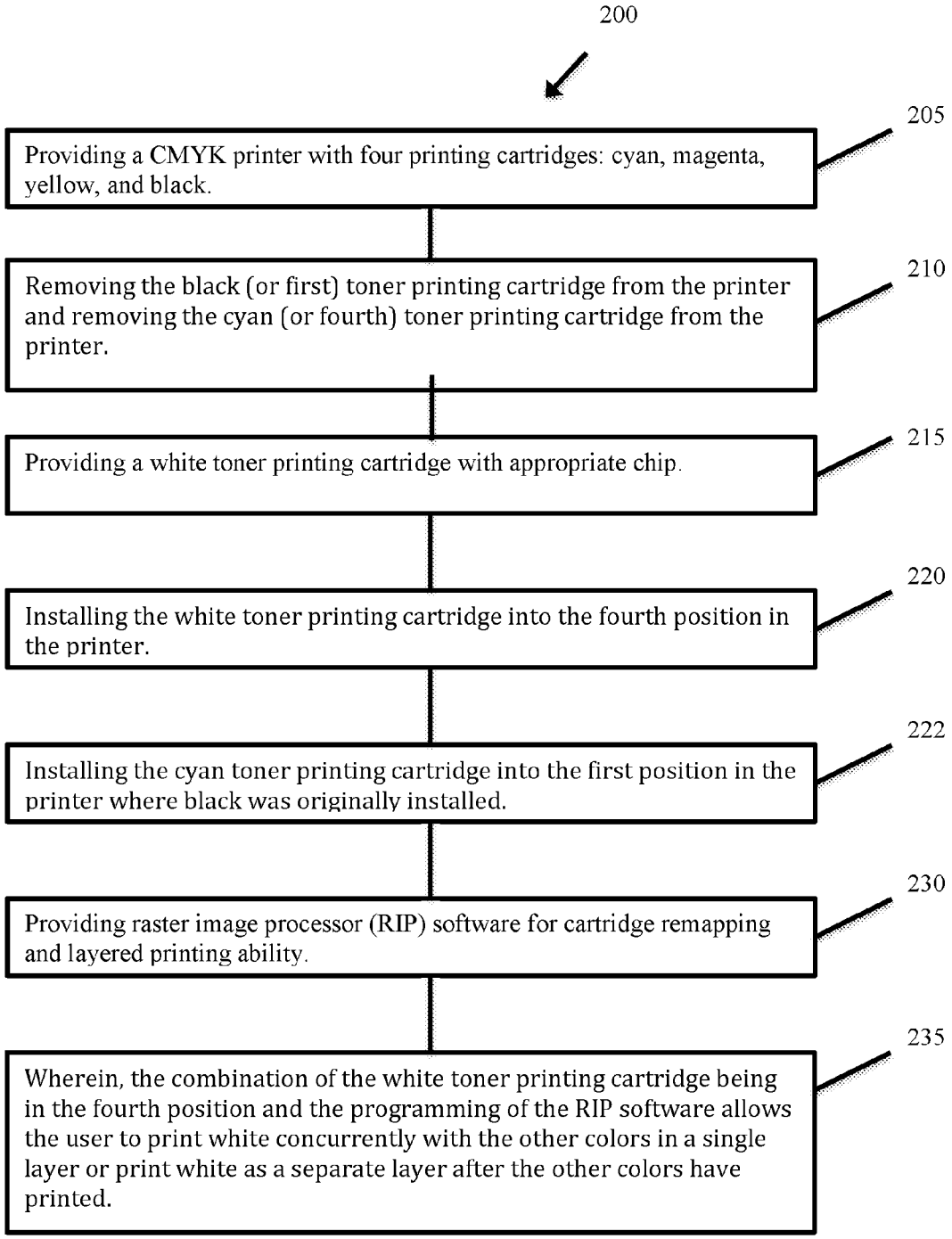
FIG. 2 is a flow block diagram of one embodiment of the method of converting a CMYK printer to print white in the foreground.

FIG. 2 is a flow block diagram of another embodiment of the method of converting a CMYK printer to print with white toner in the foreground. As shown in FIG. 2, the conversion method 200 may comprise providing a CMYK printer with four printing cartridges: cyan, magenta, yellow, and black 205. In one embodiment, the black toner printing cartridge may be in the first printing cartridge position and the cyan toner printing cartridge may be in the fourth printing cartridge position. With the white toner cartridge in the first or last slot the other color positions do not matter as long as they are mapped properly. For printing white in the foreground the white toner printing cartridge is preferably in the fourth position. The method 200 may further comprise removing the black toner printing cartridge and/or drum cartridge from the printer and removing the cyan toner printing cartridge from the printer 210. If there is only one drum cartridge that services all of the printing cartridges, the drum must be cleaned and primed with the appropriate clear, white, or cyan toner at the appropriate location on the drum. The method 200 may further comprise: providing a white toner printing cartridge and/or drum cartridge 215; installing the white toner printing cartridge and/or drum cartridge into the fourth slot or position in the printer 220, which previously housed the cyan toner printing cartridge; installing the cyan toner printing cartridge and/or drum cartridge into the first slot or position in the printer 222, which previously housed the black printing cartridge; and providing raster image processor (RIP) software for printing cartridge remapping 230. Wherein, the combination of the white toner printing cartridge being in the fourth position and the programming of the RIP software allows the user to print white concurrently with the other colors in a single layer or print white as a separate layer after the other colors have printed 235. The white toner printing cartridge may be provided by disassembling the black removed printing cartridge, emptying and cleaning the black removed printing cartridge to create an empty printing cartridge, and then filling the empty printing cartridge with a white toner.

This method may also be used to create spot color white cartridges. When white is printed as a separate layer after the other colors have printed, spot white may be printed around the first layer to produce white as a finished color. Traditional printers without specialized software take all white colors as a "page is white" and ignore the request to print in white. Traditional printers consider anything white as the color of the paper and do not print anything in the white areas. When a user creates a spot white color in a graphic to be printed, the present printer RIP software recognizes this as a printable color and prints using pure white toner.

The modified printer may be converted back to a traditional CMYK printer by removing the white and cyan toner printing cartridges and/or drum cartridges from the fourth and first slots in the CMYK printer and re-installing the cyan and black toner printing cartridges and/or drum cartridge into their original positions.

Figure 3:
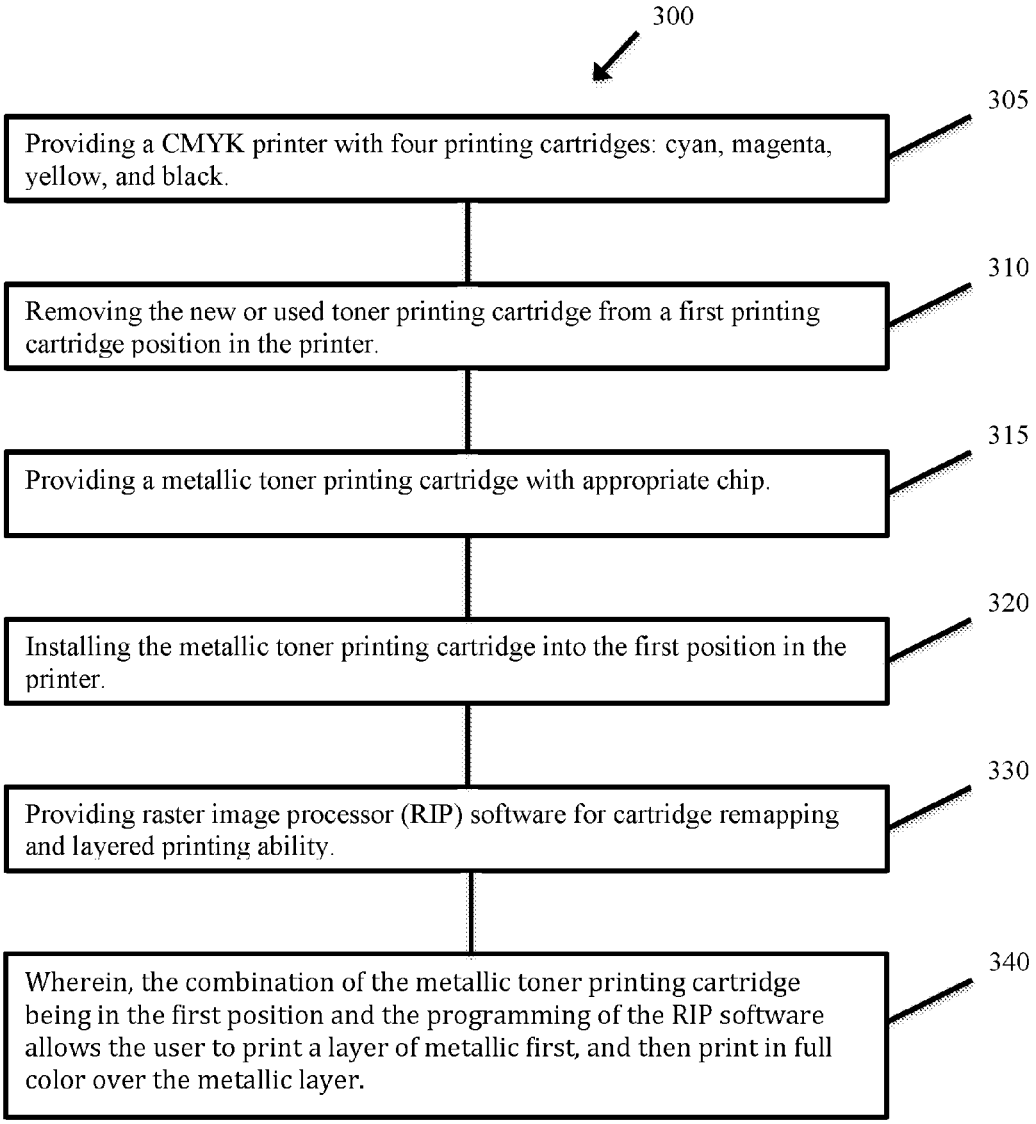
FIG. 3 is a flow block diagram of one embodiment of the method of converting a CMYK printer to print metallic in the background.

FIG. 3 is a flow block diagram of one embodiment of the method of converting a CMYK printer to print metallic in the background. As shown in FIG. 3, the conversion method 300 may comprise providing a CMYK printer with four printing cartridges: cyan, magenta, yellow, and black 305. Preferably, the CMYK printer is a LED printer. In one embodiment the black toner printing cartridge may be in the first printing cartridge position. The method 300 may further comprise removing the black printing cartridge and/or drum cartridge from the printer 310. If there is only one drum cartridge that services all of the printing cartridges, the drum must be cleaned and primed with the metallic toner. The method 300 may further comprise: providing a metallic toner printing cartridge and/or drum cartridge 315; installing the metallic toner and/or drum cartridge into the first slot or position in the CMYK printer 320; and providing raster image processor (RIP) software for printing cartridge remapping 330. Wherein, the combination of the metallic toner printing cartridge being in the first position and the programming of the RIP software allows the user to print a layer of metallic first, and then print in full color over the metallic layer 340. The metallic toner printing cartridge may be provided by disassembling the removed printing cartridge, emptying and cleaning the removed printing cartridge to create an empty printing cartridge, and then filling the empty printing cartridge with a metallic toner.

The metallic toner may be any metallic toner, including, but not limited to, gold, copper, brass, bronze, platinum, chrome, silver, and metallic tones of standard colors, such as metallic magenta, metallic yellow, and metallic cyan.

The installation may be of a used or new toner printing cartridge.

Regarding the RIP software, the RIP software utilizes printing cartridge mapping to enable the ability to move, change or swap printing cartridge locations in the printer. This allows metallic toner under printing or over printing in a single pass. The RIP software may also add a customizable separate layer of metallic either on top or underneath the image depending on the cartridge configuration and printing needs. This fully customizable feature in the software (RIP) allows you to completely reconfigure the printer to get almost any desired effect. However, in a preferred embodiment the metallic toner background layer may be printed when the metallic toner is placed in the first printing cartridge position. Additionally, in a preferred embodiment the metallic toner foreground layer may be printed when the metallic toner is place in the last printing cartridge position. Although the metallic colors can be used as an under printer or over print for unique print effects, another more probable use would be as a spot color. For example, if the black toner is removed and replaced with silver toner, and the CMY cartridges are left as is, anything black would print as silver. Thus, if black was part of a created color to be printed, the resulting print job would have areas with a metallic sheen, rather than being darker. This effect can be done by any metallic color.

The RIP software may also be configured to allow the user to print in full color, CMY black, and metallic, such that the metallic prints with the other colors at the same time in a single layer. Preferably, the single layer is put down in a single pass.

The modified printer may be converted back to a traditional CMYK printer by removing the metallic toner and/or drum cartridge from the first slot in the CMYK printer and re-installing the black toner printing cartridge and/or drum cartridge (if needed).

Figure 4:
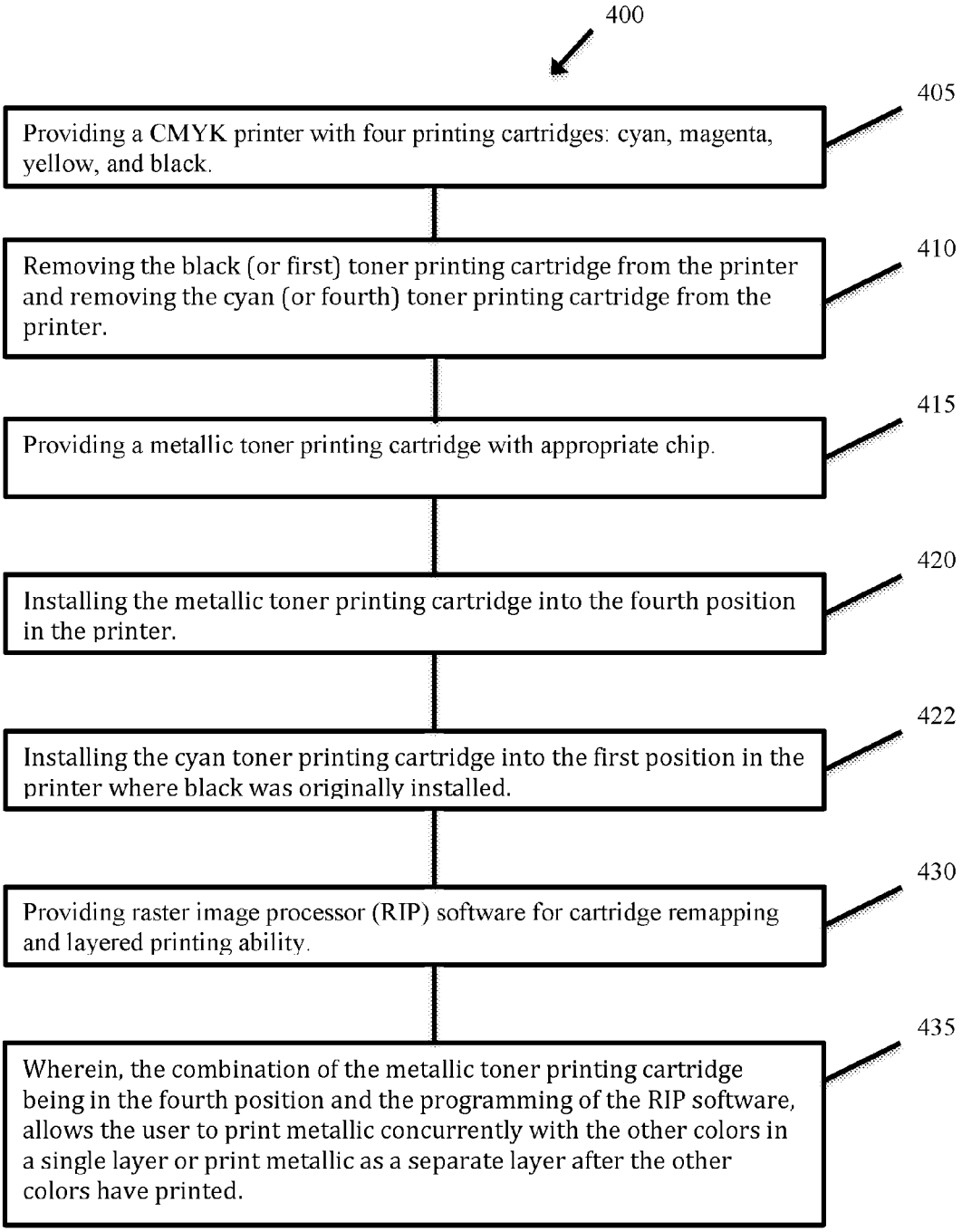
FIG. 4 is a flow block diagram of one embodiment of the method of converting a CMYK printer to print metallic in the foreground.

FIG. 4 is a flow block diagram of one embodiment of the method of converting a CMYK printer to print metallic in the foreground. As shown in FIG. 4, the conversion method 400 may comprise providing a CMYK printer with four printing cartridges: cyan, magenta, yellow, and black 405. In one embodiment, the black toner printing cartridge may be in the first printing cartridge position and the cyan toner printing cartridge may be in the fourth printing cartridge position. With the metallic in the first or last slot the other color positions do not matter as long as they are mapped properly. For printing metallic in the foreground the metallic toner printing cartridge is preferably in the fourth position. The method 400 may further comprise removing the black toner printing cartridge and/or drum cartridge from the printer and removing the cyan toner printing cartridge from the printer 410. If there is only one drum cartridge that services all of the printing cartridges, the drum must be cleaned and primed with the appropriate metallic or cyan toner at the appropriate location on the drum. The method 400 may further comprise: providing a metallic toner printing cartridge and/or drum cartridge 415; installing the metallic toner printing cartridge and/or drum cartridge into the fourth slot or position in the printer 420, which previously housed the cyan toner printing cartridge; installing the cyan toner printing cartridge and/or drum cartridge into the first slot or position in the printer 422, which previously housed the black printing cartridge; and providing raster image processor (RIP) software for printing cartridge remapping 430. Wherein, the combination of the metallic toner printing cartridge being in the fourth position and the programming of the RIP software allows the user to print metallic concurrently with the other colors in a single layer or print metallic as a separate layer after the other colors have printed 435. The metallic toner printing cartridge may be provided by disassembling the black removed printing cartridge, emptying and cleaning the black removed printing cartridge to create an empty printing cartridge, and then filling the empty printing cartridge with a metallic toner.

The metallic toner may be any metallic toner, including, but not limited to, gold, copper, brass, bronze, platinum, chrome, silver, and metallic tones of standard colors, such as metallic magenta, metallic yellow, and metallic cyan.

The modified printer may be converted back to a traditional CMYK printer by removing the metallic and cyan toner printing cartridges and/or drum cartridges from the fourth and first slots in the CMYK printer and re-installing the cyan and black toner printing cartridges and/or drum cartridge into their original positions.

Figure 5:
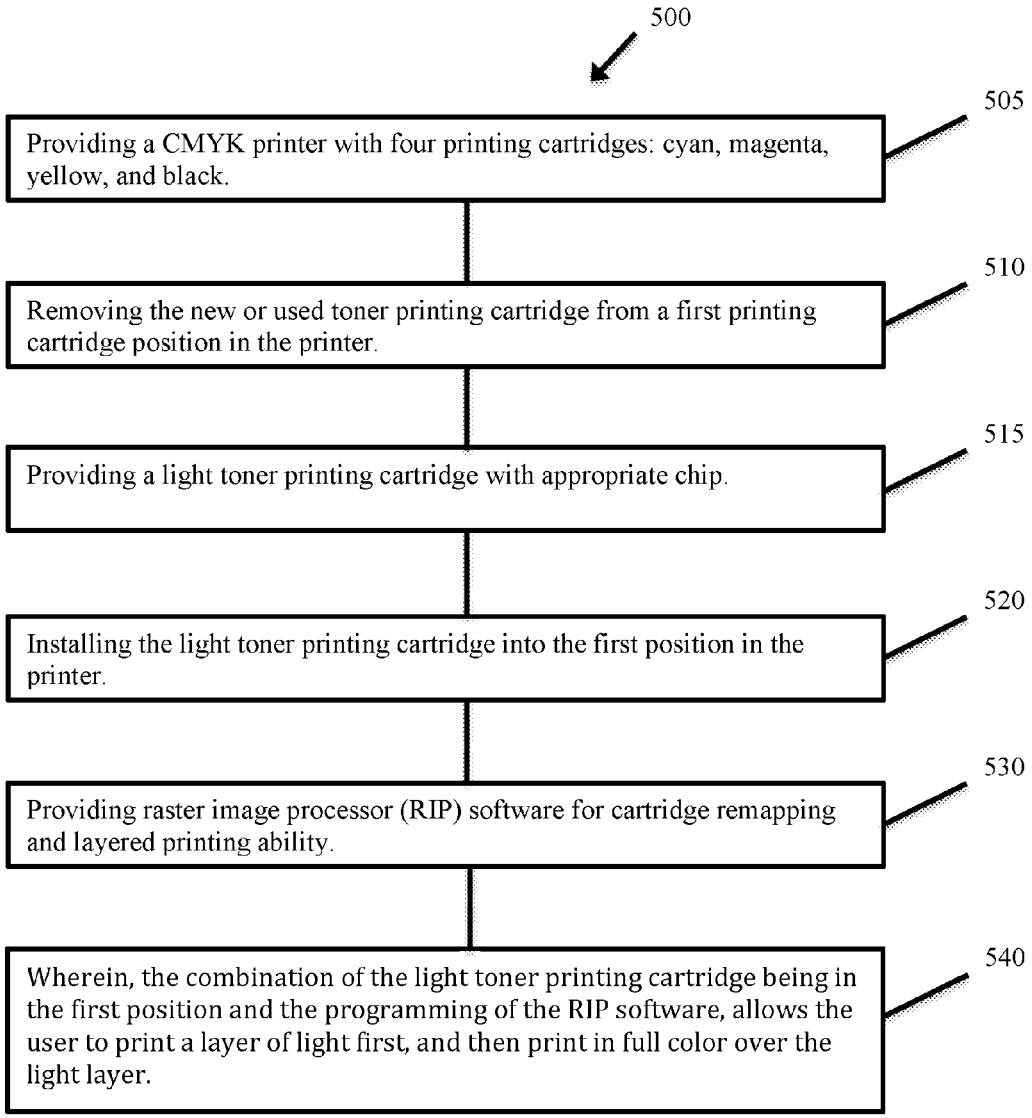
FIG. 5 is a flow block diagram of one embodiment of the method of converting a CMYK printer to print light in the background.

FIG. 5 is a flow block diagram of one embodiment of the method of converting a CMYK printer to print light in the background. As shown in FIG. 5, the conversion method 500 may comprise providing a CMYK printer with four printing cartridges: cyan, magenta, yellow, and black 505. Preferably, the CMYK printer is a LED printer. In one embodiment the black toner printing cartridge may be in the first printing cartridge position. The method 500 may further comprise removing the black printing cartridge and/or drum cartridge from the printer 510. If there is only one drum cartridge that services all of the printing cartridges, the drum must be cleaned and primed with the light toner. The method 500 may further comprise: providing a light toner printing cartridge and/or drum cartridge 515; installing the light toner and/or drum cartridge into the first slot or position in the CMYK printer 520; and providing raster image processor (RIP) software for printing cartridge remapping 530. Wherein, the combination of the light toner printing cartridge being in the first position and the programming of the RIP software allows the user to print a layer of light first, and then print in full color over the light layer 540. The light toner printing cartridge may be provided by disassembling the removed printing cartridge, emptying and cleaning the removed printing cartridge to create an empty printing cartridge, and then filling the empty printing cartridge with a light toner.

The light toner may be any light toner, including, but not limited to, light magenta or light cyan.

The installation may be of a used or new toner printing cartridge.

Regarding the RIP software, the RIP software utilizes printing cartridge mapping to enable the ability to move, change or swap printing cartridge locations in the printer. This allows light under printing or over printing in a single pass. The RIP software may also add a customizable separate layer of light either on top or underneath the image depending on the cartridge configuration and printing needs. This fully customizable feature in the software (RIP) allows you to completely reconfigure the printer to get almost any desired effect. However, in a preferred embodiment, the light toner background layer may be printed when the light toner is placed in the first printing cartridge position. Additionally, in a preferred embodiment, the light toner foreground layer may be printed when the light toner is place in the last printing cartridge position.

The RIP software may also be configured to allow the user to print in full color, CMY black, and light, such that the light prints with the other colors at the same time in a single layer. Preferably, the single layer is put down in a single pass.

The modified printer may be converted back to a traditional CMYK printer by removing the light toner and/or drum cartridge from the first slot in the CMYK printer and re-installing the black toner printing cartridge and/or drum cartridge (if needed).

Figure 6:
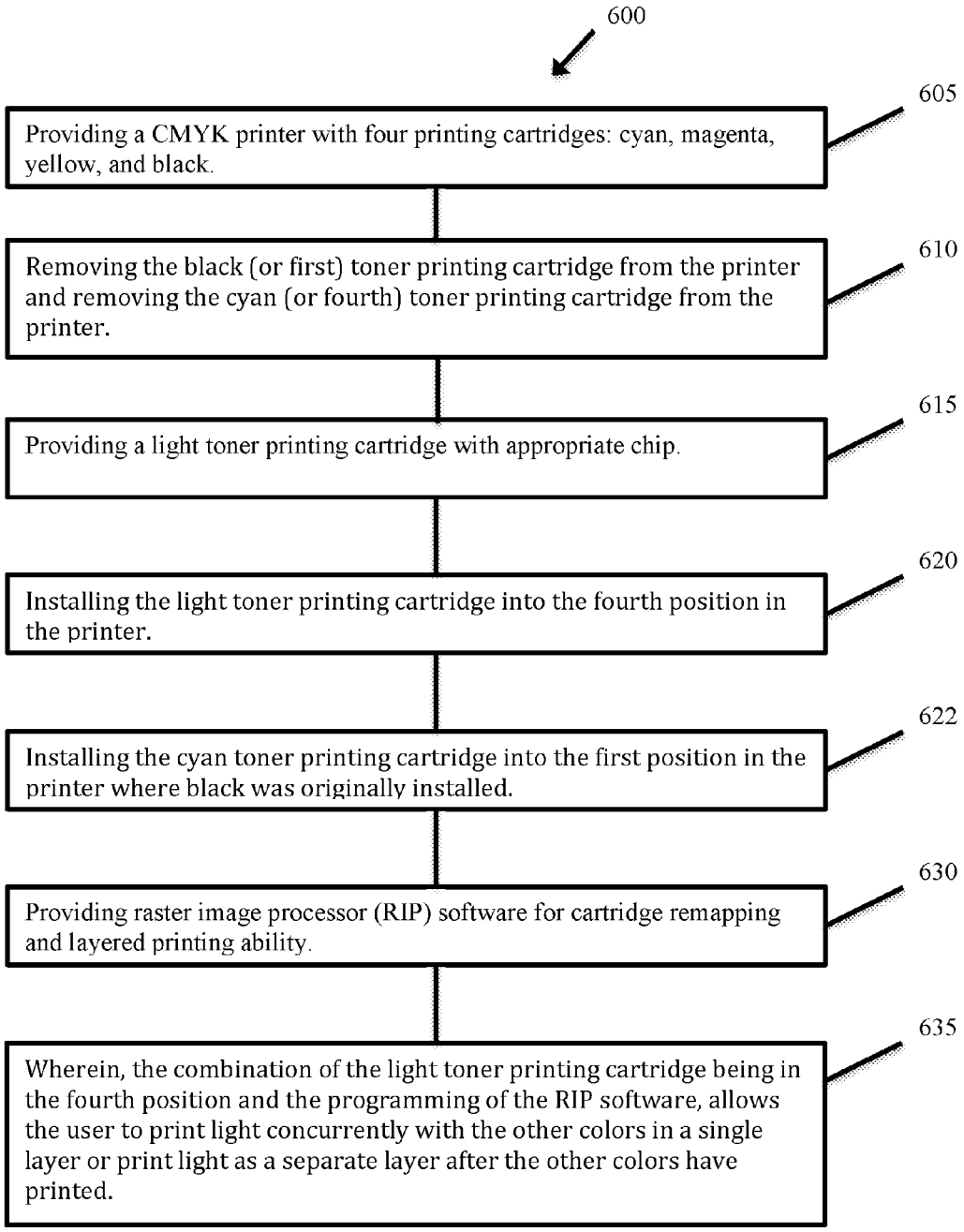
FIG. 6 is a flow block diagram of one embodiment of the method of converting a CMYK printer to print light in the foreground.

FIG. 6 is a flow block diagram of one embodiment of the method of converting a CMYK printer to print light in the foreground. As shown in FIG. 6, the conversion method 600 may comprise providing a CMYK printer with four printing cartridges: cyan, magenta, yellow, and black 605. In one embodiment, the black toner printing cartridge may be in the first printing cartridge position and the cyan toner printing cartridge may be in the fourth printing cartridge position. With the light in the first or last slot the other color positions do not matter as long as they are mapped properly. For printing light in the foreground the light toner printing cartridge is preferably in the fourth position. The method 600 may further comprise removing the black toner printing cartridge and/or drum cartridge from the printer and removing the cyan toner printing cartridge from the printer 610. If there is only one drum cartridge that services all of the printing cartridges, the drum must be cleaned and primed with the appropriate light or cyan toner at the appropriate location on the drum. The method 600 may further comprise: providing a light toner printing cartridge and/or drum cartridge 615; installing the light toner printing cartridge and/or drum cartridge into the fourth slot or position in the printer 620, which previously housed the cyan toner printing cartridge; installing the cyan toner printing cartridge and/or drum cartridge into the first slot or position in the printer 622, which previously housed the black printing cartridge; and providing raster image processor (RIP) software for printing cartridge remapping 630. Wherein, the combination of the light toner printing cartridge being in the fourth position and the programming of the RIP software allows the user to print light concurrently with the other colors in a single layer or print light as a separate layer after the other colors have printed 635. The light toner printing cartridge may be provided by disassembling the black removed printing cartridge, emptying and cleaning the black removed printing cartridge to create an empty printing cartridge, and then filling the empty printing cartridge with a light toner.

In another embodiment, if a user replaced the CMY with Light Cyan, Light Magenta, and Light Yellow, this might not be used for over or under printing. Instead, they would directly replace the standard CMY toners, which would have a unique effect on the colors being printed.

The modified printer may be converted back to a traditional CMYK printer by removing the metallic and cyan toner printing cartridges and/or drum cartridges from the fourth and first slots in the CMYK printer and re-installing the cyan and black toner printing cartridges and/or drum cartridge into their original positions.

The light toner may be any light toner, including, but not limited to, light magenta or light cyan.

Figure 7:
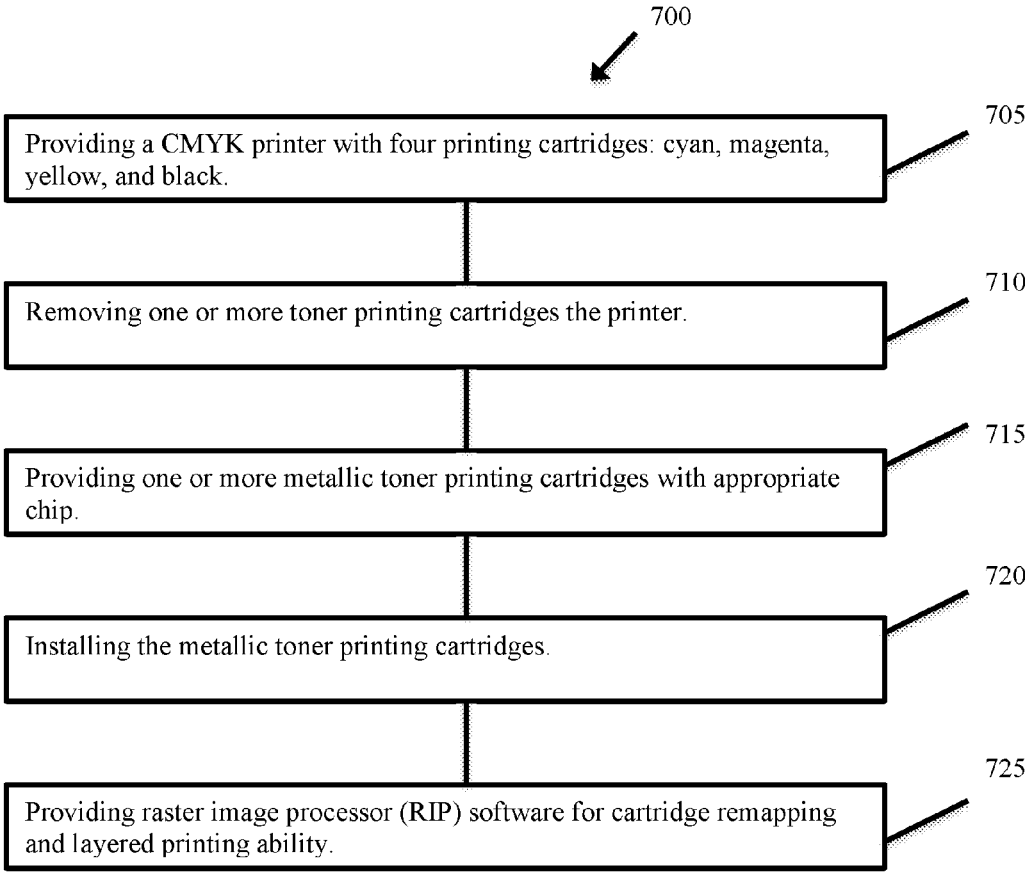
FIG. 7 is a flow block diagram of one embodiment of the method of converting a CMYK printer to print with metallic toner.

FIG. 7 is a flow block diagram of another embodiment of the method of converting a CMYK printer to print with metallic toner. As shown in FIG. 7, the conversion method 700 may comprise providing a CMYK printer with four printing cartridges: cyan, magenta, yellow, and black 705. In one embodiment, the method 700 may comprise removing one or more printing cartridges and/or drum cartridges from the printer 710. If there is only one drum cartridge that services all of the printing cartridges, the drum must be cleaned and primed with the appropriate metallic toner at the appropriate location on the drum. The method 700 may further comprise: providing one or more metallic toner printing cartridges and/or drum cartridges 715; installing the metallic printing cartridge and/or drum cartridge 720; and providing raster image processor (RIP) software for printing cartridge remapping 725. Wherein, the metallic toner printing cartridge(s) and the programming of the RIP software allows the user to print metallic concurrently with the other colors in a single layer or print metallic as a separate layer. The metallic toner printing cartridge may be provided by disassembling one or more removed printing cartridges, emptying and cleaning the removed printing cartridge to create an empty printing cartridge, and then filling the empty printing cartridge with a metallic toner.

The modified printer may be converted back to a traditional CMYK printer by removing the metallic toner printing cartridge and/or drum cartridge in the CMYK printer and re-installing the color toner printing cartridge and/or drum cartridge into the original positions.

In one embodiment, a CMYK printer, such as a CMYW printer, may be altered to feature any combination of metallic or standard colors.

Figure 8:
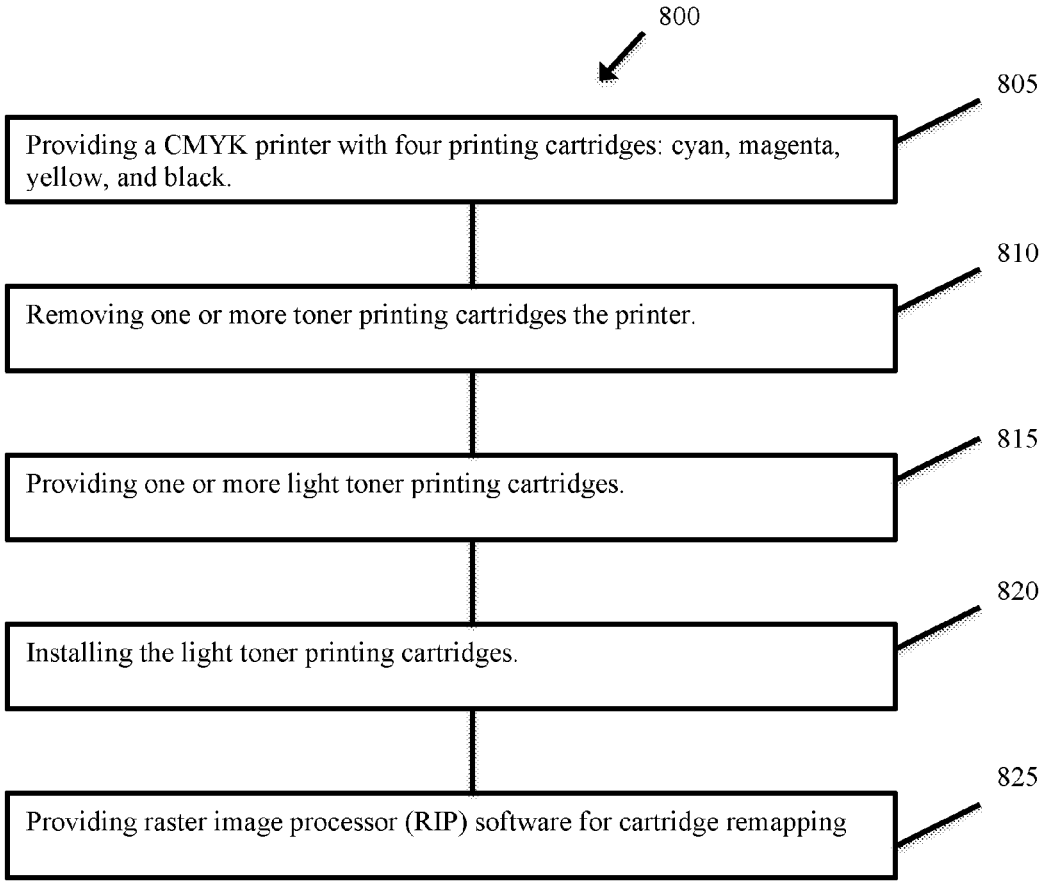
FIG. 8 is a flow block diagram of one embodiment of the method of converting a CMYK printer to print with light toner.

FIG. 8 is a flow block diagram of another embodiment of the method of converting a CMYK printer to print with light toner. As shown in FIG. 8, the conversion method 800 may comprise providing a CMYK printer with four printing cartridges: cyan, magenta, yellow, and black 805. In one embodiment, the method 800 may comprise removing one or more printing cartridges and/or drum cartridges from the printer 810. If there is only one drum cartridge that services all of the printing cartridges, the drum must be cleaned and primed with the appropriate light toner at the appropriate location on the drum. The method 800 may further comprise: providing one or more light toner printing cartridges and/or drum cartridges 815; installing the light printing cartridge and/or drum cartridge 820; and providing raster image processor (RIP) software for printing cartridge remapping 825. Wherein, the light toner printing cartridge(s) and the programming of the RIP software allows the user to print light concurrently with the other colors in a single layer or print light as a separate layer. The light toner printing cartridge may be provided by disassembling one or more removed printing cartridges, emptying and cleaning the removed printing cartridge to create an empty printing cartridge, and then filling the empty printing cartridge with a light toner.

The modified printer may be converted back to a traditional CMYK printer by removing the light toner printing cartridge and/or drum cartridge in the CMYK printer and re-installing the color toner printing cartridge and/or drum cartridge into the original positions.

In one embodiment, a CMYK printer, such as a CMYW printer, may be altered to feature any combination of light or standard colors.

Figure 9:
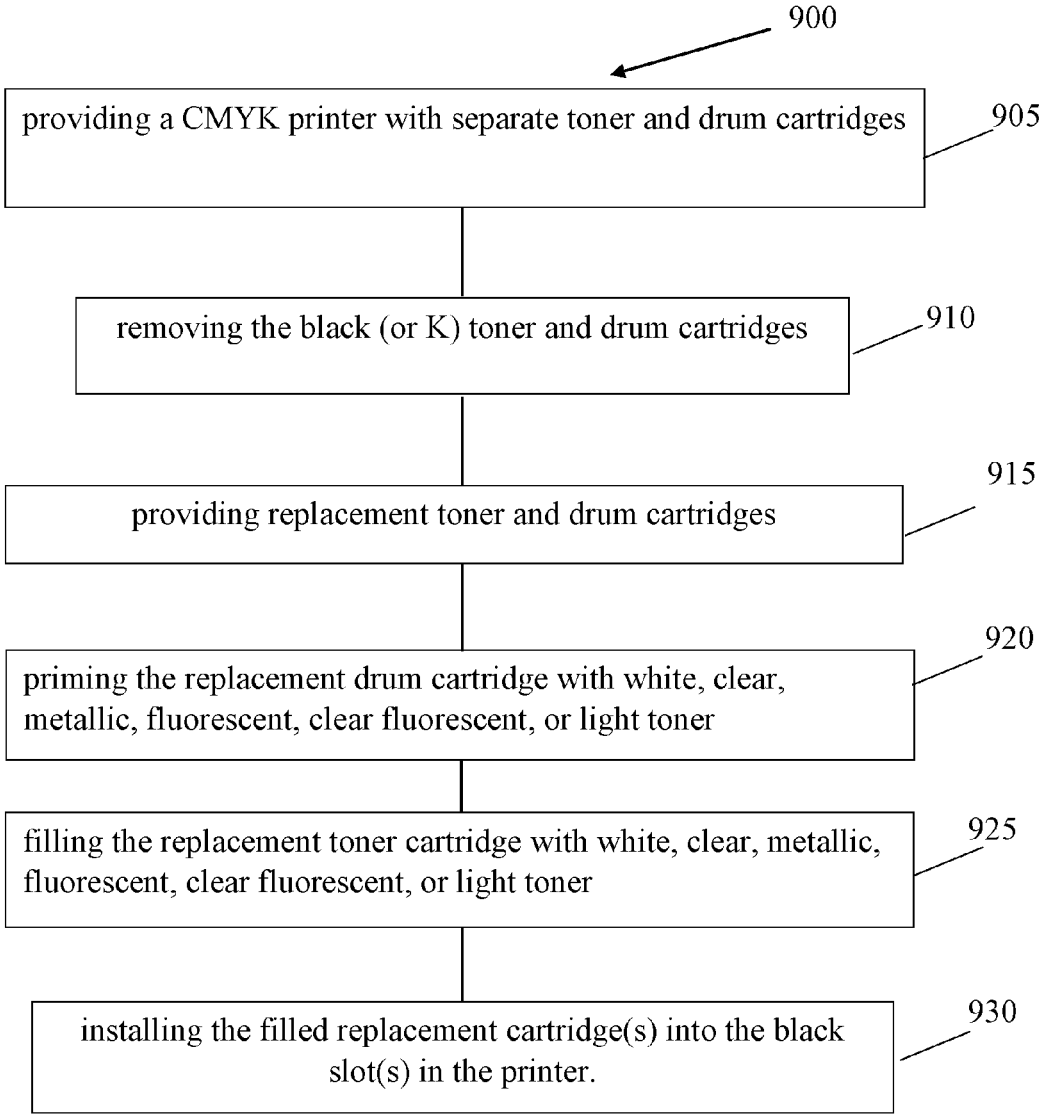
FIG. 9 is a flow block diagram of one embodiment of the method of converting a printer to print with white, clear, metallic, fluorescent, or light toner with a single cartridge conversion.

FIG. 9 is a flow block diagram of one embodiment of the method of converting a printer to print with a non-standard toner, such as white, clear, metallic, fluorescent, clear fluorescent, or light toner. FIG. 9 shows that the single printer cartridge conversion method 900 may comprise the steps: 905, 910, 915, 920, 925, and 930. Step 905 may be providing a CMYK printer with separate toner and drum cartridges. The method 900 may also be used with a CMYK printer, wherein each toner cartridge has a built in drum. The next step 910 may be removing the black (or K) toner and/or drum cartridges from the printer. The next step is to provide aftermarket empty cartridges (toner and/or drum), referred to as replacement toner and/or drum cartridges 915. These replacement cartridges may be new or recycled/repaired/refurbished. If the drum cartridges are separate, they may be primed with white, clear, metallic, fluorescent, clear fluorescent, or light toner powder 920. Step 925 may be filling the toner cartridge with white, clear, metallic, fluorescent, clear fluorescent, or light toner. Step 930 may be installing the filled and primed replacement cartridges into the black (K) slot(s) in the printer.

Generally, the clear fluorescent toner that is only visible under ultraviolet (UV) light.

The double printing cartridges conversion may be desirable when more than one single pass of white may be needed to get optimum coverage. This is especially true for textured media. Additionally, for clear media, it may be desirable to be able to print in pure black using black toner in the K cartridge. The double printing cartridges conversion may comprise the steps: providing a CMYK printer with separate toner and drum cartridges; removing the cyan and magenta drum and toner cartridges; emptying the cartridges of toner; disassembling and cleaning the cartridges (if used and necessary); refurbishing and repairing the cartridges; reassembling the cartridges (if separate); priming the drum cartridges with white toner powder; filling both toner cartridges with white toner; and installing the refilled and/or refurbished cartridges into the cyan and magenta slots of the printer. White may be printed by setting the text or picture color to magenta or cyan. Since one of the purposes of the double cartridge conversion may be to provide double white toner coverage for textured or clear media, the user may select a color that uses equal parts magenta and cyan. 100% Magenta and 100% Cyan is an example of where anything printed will have a pass of white from the former magenta cartridge and a pass from the former cyan cartridge. The black and yellow cartridges may have been left intact, which generally means that the image may print in black, yellow, white, and double white. The preferred color setting for the brightest whites may be as follows:

Hexidecimal: 0000ff

RGB: 255

CMYK: C: 100%, M: 100% Y: 0% K: 0%

Pantone: No exact colors match. There are 11 colors or more that are close but not exact.

Regarding an LED printer, an extra step may be performed to block the yellow from printing, so that what remains may be to have a true black and double white printer without any possibility of any color (yellow) printing. By placing a cover over the LED slot of the drum unit of the yellow, this will preferably effectively block the yellow from printing and will not generate a printer error. Some yellow toner may need to be in the drum unit for lubrication, but this lubrication amount is preferably not enough to be used for or effect the printing.

If converting a laser printer, the yellow laser slot of the drum unit may not be blocked as the printer will likely produce an error message and will not print. Because yellow color toner may be in the drum, care should be taken to avoid the yellow bleeding into the image.

Aside from printing in white, the modified printer may also print in black when black printing is set to pure 100% K. The printer can be brought back to standard CMYK printing by installing traditional magenta and cyan cartridge sets, and, if necessary, removing the LED blocking bar for the yellow on LED machines. Various embodiments of the retrofitted printer may be a CMYKB printer, wherein the B is black and K is a toner other than basic black.

Figure 10:
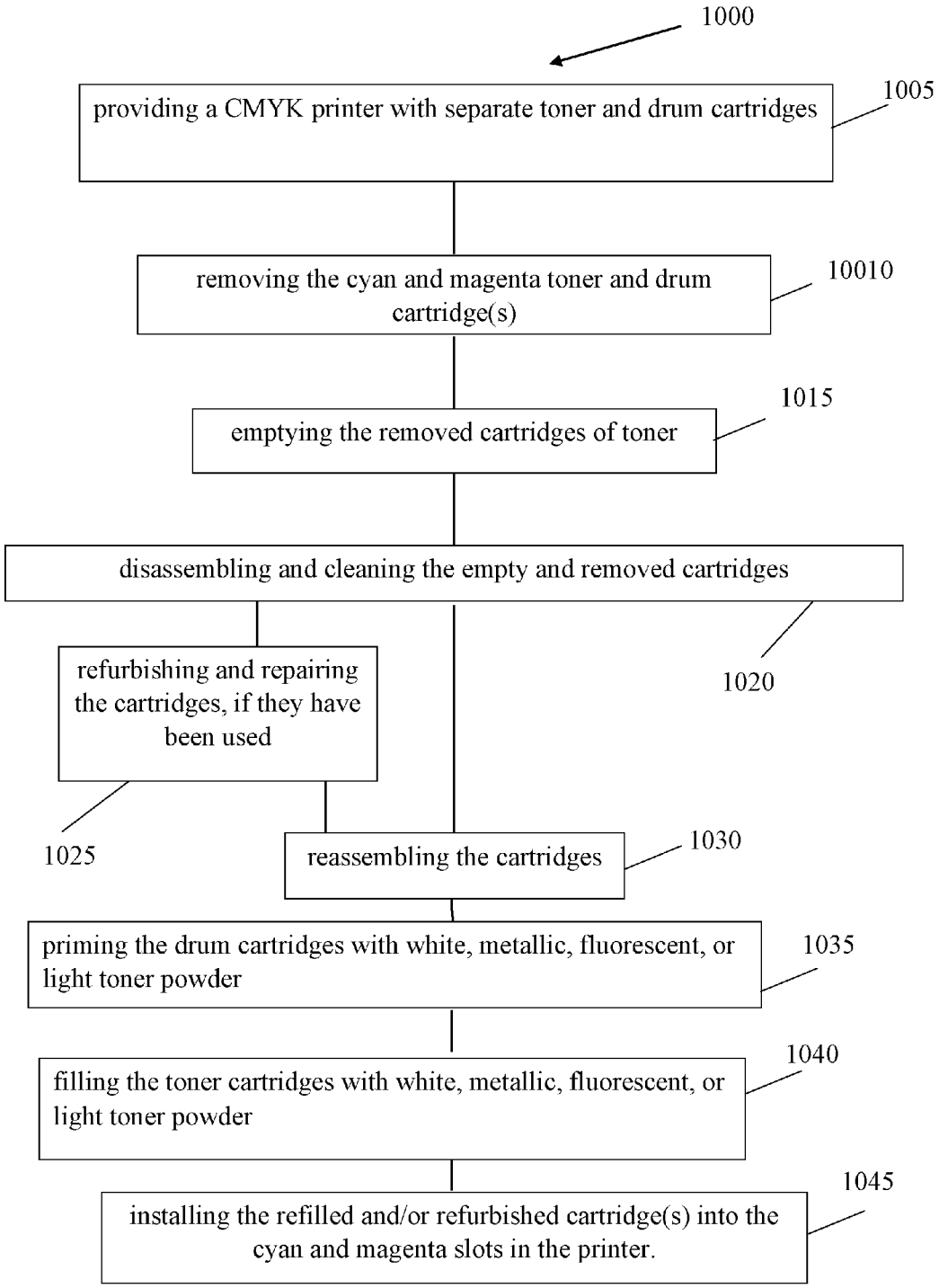
FIG. 10 is a flow block diagram of one embodiment of the method of converting a printer to print with white toner with a double cartridge conversion

FIG. 10 is a flow block diagram of another embodiment of the method of converting a printer to print with white toner and shows a double cartridge conversion of a CMYK printer. As shown in FIG. 10, the conversion method 1000 may be a double printing cartridges conversion and may comprise the steps: providing a CMYK printer with separate toner and drum cartridges 1005; removing the cyan and magenta drum and toner cartridges 1010; emptying the cartridges of toner 1015; disassembling and cleaning the empty and removed cartridges 1020; refurbishing and repairing the cartridges 1025 if used and if necessary; reassembling the cartridge 1030; priming the drum cartridges with white toner powder 1035; filling both toner cartridges with white toner 1040; and installing the refilled and/or refurbished cartridges into the cyan and magenta slots in the printer 1045.

In other embodiments, rather than emptying and refilling the removed cartridges, new empty cartridges, which are substantially structurally similar or identical to the removed cartridges, may be provided, filled, and installed, similar to the method provided in FIG. 9.

In another embodiment, the method may be a double white printing conversion of a CMYK machine that has a single drum that operates with four or more separate toner cartridges. In this embodiment, the double printing cartridges conversion may comprise the steps: providing a CMYK printer with separate toner cartridges and a single drum cartridge; removing, disassembling, and cleaning the drum cartridge (note: care should be taken to thoroughly clean the cyan and magenta portion of the drum cartridge, because these portions will be switched to white toner); reassembling the drum unit; priming the magenta and cyan sections of the drum with white toner and prime the black and yellow sections with their respective colors (note: care should be taken not spill or mix toner as any amount will stain the white toner); removing and thoroughly cleaning the magenta and cyan toner cartridges; filling the magenta and cyan toner cartridges with white toner; and installing the toner cartridge back into the printer. Because the drum unit preferably contains all four color sections, it may be preferably to keep this embodiment of modified printer as a true black and double white printing machine. A blocking plate may be installed over the LED slot of the yellow drum section, so that no yellow can be printed. Some yellow toner is preferably left in the toner cartridge for drum lubrication but this may not be enough to print in yellow. White may be printed by setting the text or picture color to magenta or cyan. Because one of the purposes of the double cartridge conversion may be to provide double white toner coverage for textured or clear media, the user may select a color that uses equal parts magenta and cyan. When converting a laser printer, the yellow laser slot of the drum unit is generally not blocked as the printer may produce an error message and will be unable to print at all. In this case, great care must be taken to remove any yellow colors from the image before printing.

Because both the magenta and cyan toner cartridges are now white, a color equal in both magenta and cyan may be used to get two printing passes of white toner. 100% Magenta and 100% Cyan is an example of where anything printed will have a pass of white from the former magenta cartridge and a pass from the former cyan cartridge. The black and yellow cartridges may have been left intact, which generally means that the image may print in black, yellow, white, and double white. The preferred color setting for the brightest whites may be as follows:

Hexidecimal: 0000ff

RGB: 255

CMYK: C: 100%, M: 100% Y: 0% K: 0%

Pantone: No exact colors match. There are 11 colors or more that are close but not exact.

Once converted, this embodiment of the printers is preferably left as dedicated black and double white machines, rather than converting the machine back to full color printing. Although not preferred, either the magenta or cyan may be converted, to create a single white printing machine.

Figure 11:
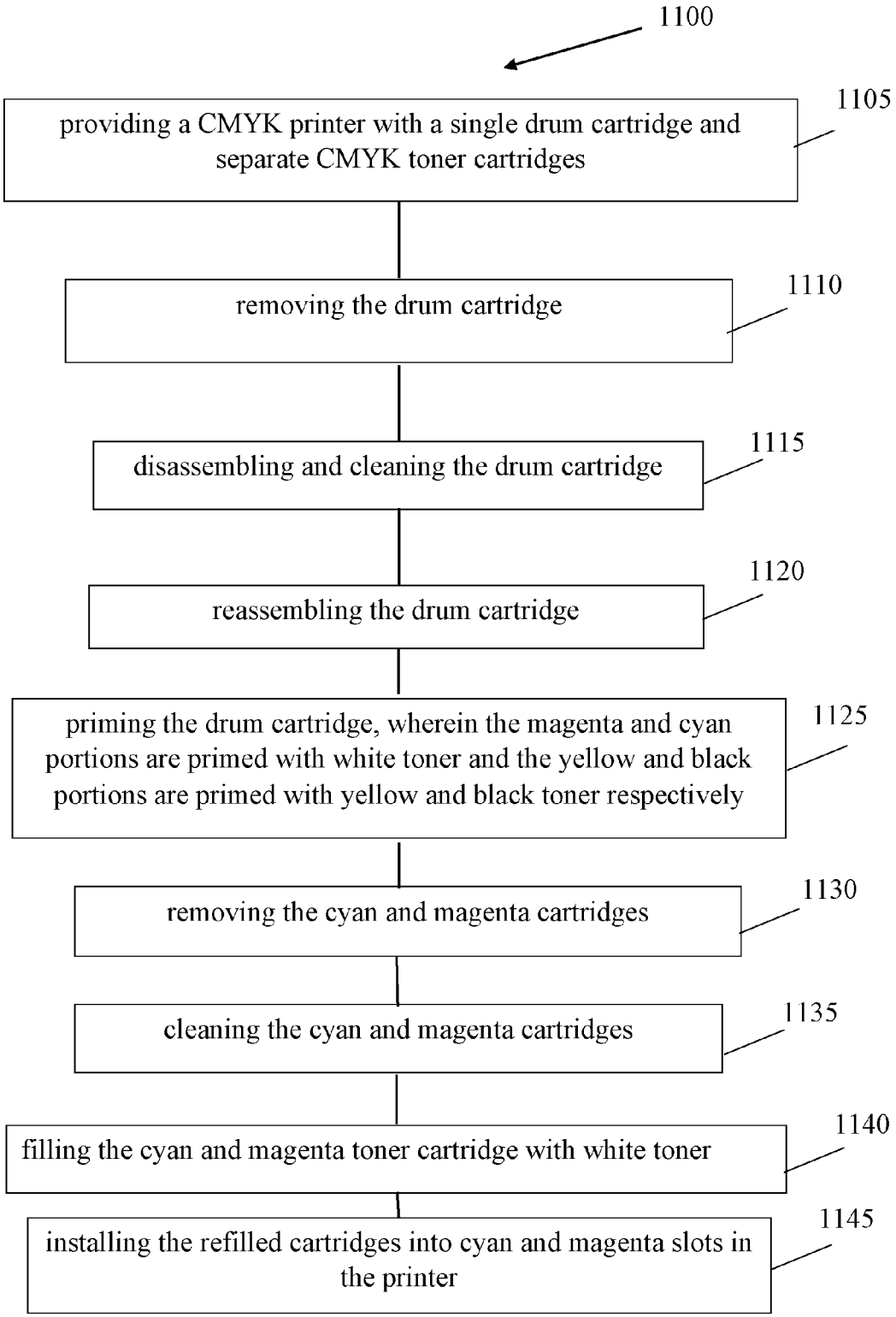
FIG. 11 is a flow block diagram of another embodiment of the method of converting a printer to print with white toner with a double cartridge conversion

FIG. 11 is a flow block diagram of another embodiment of the method of converting a printer to print with white toner. As shown in FIG. 11, this embodiment of the method 1100 may be a double white printing conversion of a CMYK printer that has a single drum that operates with four or more separate toner cartridges and may comprise the steps: providing a CMYK printer with separate toner cartridges and a single drum cartridge 1105; removing the drum cartridge 1110; disassembling and/or cleaning the drum cartridge 1115; reassembling the drum cartridge 1120; priming the magenta and cyan sections of the drum with white toner and priming the black and cyan sections with their respective colors 1125; removing the magenta and cyan toner cartridges 1130; thoroughly cleaning the cyan and magenta cartridges 1135; filling the magenta and cyan toner cartridges with white toner 1140; and installing the toner cartridge back into the printer 1145.

In other embodiments, rather than emptying and refilling the removed toner and drum cartridges, new empty toner and drum cartridges, which are substantially structurally similar or identical to the removed cartridges, may be provided, filled, and installed, similar to the method provided in FIG. 9.

In another embodiment, a black only, or otherwise, monochromatic printer may be converted to print white. The retrofitted monochromatic printer may have either a separate toner and drum unit or a combined toner and drum cartridge. Regarding printers with separate toner and drum cartridges, both separate cartridges may be removed and replaced with replacement empty cartridges (new or used) that are filled with white, clear, metallic, fluorescent, clear fluorescent, or light toner. Machines with combined cartridges may be removed and replaced with replacement empty cartridges that are filled with white, clear, metallic, fluorescent, clear fluorescent, or light toner. Preferably, the white, clear, metallic, fluorescent, or clear fluorescent, light toner image printed is set to print in pure black or K. The monochromatic white, clear, metallic, fluorescent, clear fluorescent, or light toner printer may be switched back to black by simply changes the cartridge(s) back to black.

Figure 12:
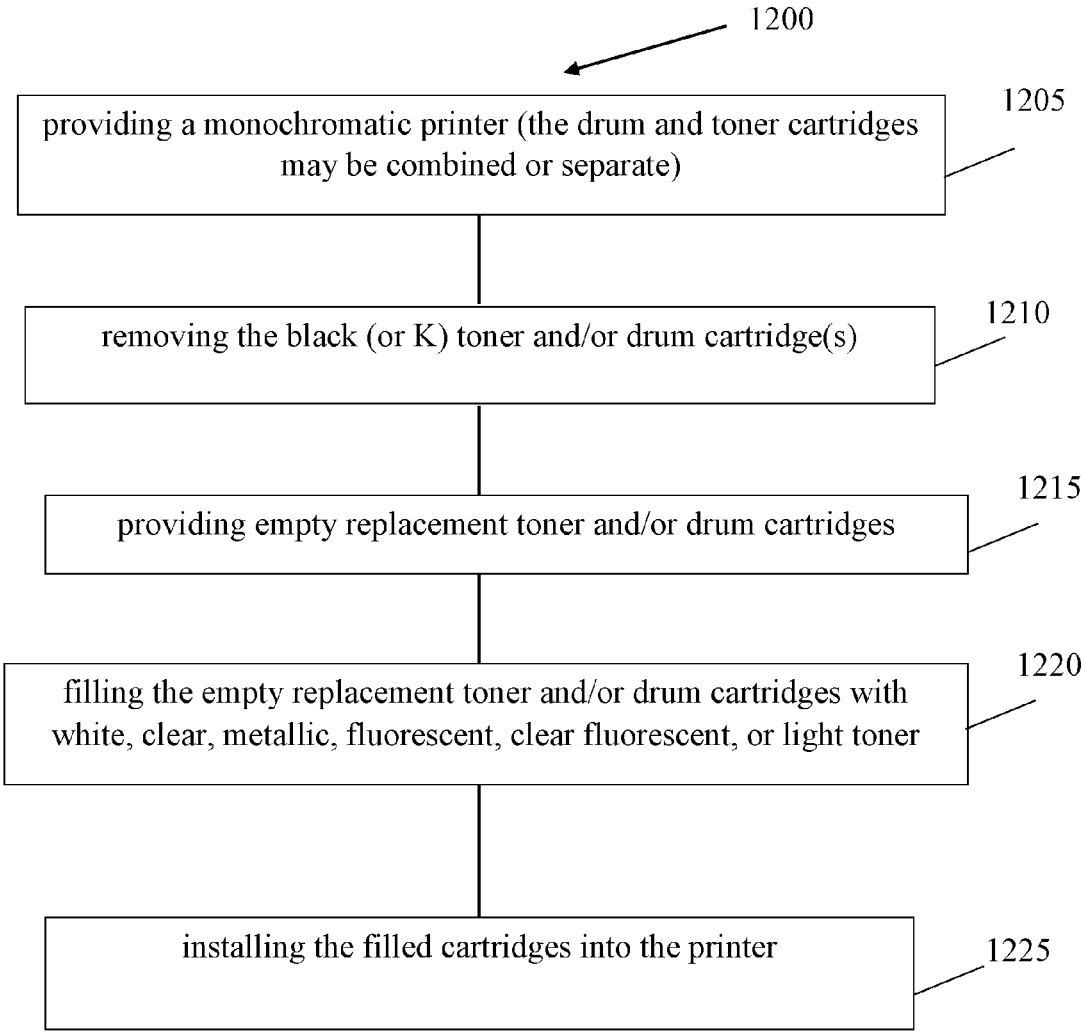
FIG. 12 is a flow block diagram of another embodiment of the method of converting a monochromatic printer to print with white, clear, metallic, fluorescent, or light toner.

FIG. 12 is a flow block diagram of another embodiment of the method of converting a printer to print with a non-standard toner, such as white, clear, metallic, fluorescent, clear fluorescent, or light toner. As shown in FIG. 12, the method 1200 may comprise: providing a monochromatic printer (the drum and toner cartridges may be combined or separate) 1205; removing the black (or K) toner and/or drum cartridge(s) 1210; providing empty replacement cartridges 1215; filling the replacement toner and/or drum cartridges with white, clear, metallic, fluorescent, clear fluorescent, or light toner powder 1235, and installing the toner cartridge back into the printer 1240. Generally, the clear fluorescent toner is only visible under ultraviolet (UV) light.

Figure 13:
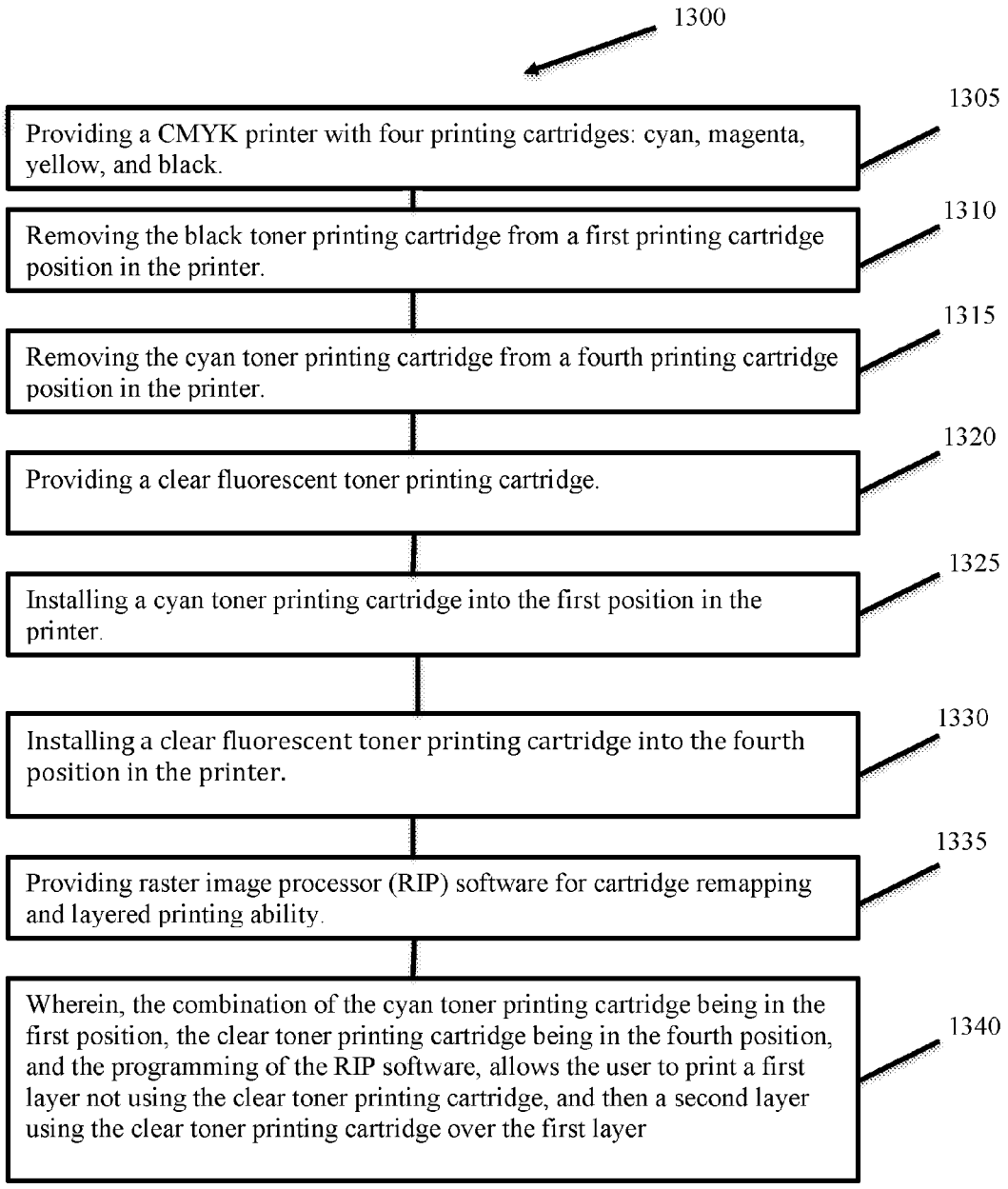
FIG. 13 is a flow block diagram of another embodiment of the method of converting a CMYK printer to print with fluorescent clear toner that is only visible under an ultraviolet light.

FIG. 13 is a flow block diagram of another embodiment of the method of converting a CMYK printer to print with clear fluorescent toner that is only visible under ultraviolet (UV) light. As shown in FIG. 13, one embodiment of the conversion method 1300 may comprise providing a CMYK printer with four printing cartridges: cyan, magenta, yellow, and black 1305. In one embodiment, the black toner printing cartridge may be in the first printing cartridge position and the cyan toner printing cartridge may be in the fourth printing cartridge position. With a clear fluorescent toner printing cartridge in the first or last slot, the other color positions do not matter as long as they are mapped properly. For printing clear as a second layer, the clear fluorescent toner printing cartridge is preferably in the fourth position. The method 1300 may further comprise removing the black (or first) toner printing cartridge and/or drum cartridge from the printer and removing the cyan (or fourth) toner printing cartridge from the printer 1310, 1315. If there is only one drum cartridge that services all of the printing cartridges, the drum must be cleaned and primed with the appropriate clear fluorescent toner or cyan toner at the appropriate location on the drum. The method 1300 may further comprise: providing a clear fluorescent toner printing cartridge and/or drum cartridge 1320; installing the clear fluorescent toner printing cartridge and/or drum cartridge into the fourth slot or position in the printer 1330, which previously housed the cyan toner printing cartridge; installing the cyan toner printing cartridge and/or drum cartridge into the first slot or position in the printer 1325, which previously housed the black printing cartridge; and providing raster image processor (RIP) software for printing cartridge remapping and layered printing ability 1335. Wherein, the combination of the clear fluorescent toner printing cartridge being in the fourth position and the programming of the RIP software, allows the user to print clear fluorescent concurrently with the other colors in a single layer or print clear fluorescent as a separate layer after the other colors have printed 1340. The clear fluorescent toner printing cartridge preferably has the appropriate chip. The clear fluorescent toner printing cartridge may be provided by disassembling the black removed printing cartridge, emptying and cleaning the black removed printing cartridge to create an empty printing cartridge, and then filling the empty printing cartridge with a fluorescent toner toner. Alternatively, the clear toner printing cartridge may be new and unused or used and refurbished.

The modified printer may be converted back to a traditional CMYK printer by removing the fluorescent toner and cyan toner printing cartridges and/or drum cartridges from the fourth and first slots in the CMYK printer and reinstalling the cyan and black toner printing cartridges and/or drum cartridge into their original positions.

In one embodiment, a CMYK printer, such as a CMYW or CMYB printer, may be altered to feature any combination of clear fluorescent or standard colors.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting a printer to print with metallic toner, comprising the steps:

providing a toner printer;

wherein said toner printer has four printing cartridges;

wherein said four printing cartridges comprise a black toner printing cartridge, a cyan toner printing cartridge, a magenta toner printing cartridge, and a yellow toner printing cartridge;

wherein said black toner printing cartridge is in a first position of said toner printer;

removing said black toner printing cartridge from said toner printer;

wherein said cyan toner printing cartridge is in a fourth position of said toner printer;

removing said cyan toner printing cartridge from said toner printer;

providing a metallic toner printing cartridge;

installing said cyan toner printing cartridge into said first position of said toner printer;

installing said metallic toner printing cartridge into said fourth position of said toner printer; and providing raster image processor (RIP) software for printing cartridge remapping;

wherein said providing of said metallic toner printing cartridge comprises: disassembling said removed black toner printing cartridge; emptying and cleaning said removed black toner printing cartridge, such that an empty printing cartridge is created; and filling said empty printing cartridge with a metallic toner.

2. The method of converting a printer to print with metallic toner of claim 1, wherein said metallic toner is selected from the group of metallic toners consisting of: gold, copper, brass, bronze, platinum, chrome, silver, metallic magenta, metallic yellow, and metallic cyan.

3. The method of converting a printer to print with metallic toner of claim 1, further comprising the steps:

printing a first layer not using said metallic toner printing cartridge, and then printing a second layer over said first layer;

wherein said second layer prints only using said metallic toner printing cartridge.

4. The method of converting a printer to print with metallic toner of claim 1, further comprising the step:

printing a layer using all four of said four toner printing cartridges.

5. The method of converting a printer to print with metallic toner of claim 1, wherein said printer is a LED toner printer.

6. The method of converting a printer to print with metallic toner of claim 1, wherein said four toner printing cartridges of said printer comprise four separate drums and four separate toner printing cartridges.

7. The method of converting a printer to print with metallic toner of claim 1, wherein said four toner printing cartridges of said printer comprise four separate toner printing cartridges and one single drum cartridge.

8. The method of converting a printer to print with metallic toner of claim 1, wherein said four toner printing cartridges of said printer comprise four combined toner and drum printing cartridges.

9. A method of converting a printer to print with light toner, comprising the steps:

providing a toner printer;

wherein said toner printer has four printing cartridges;

wherein said four printing cartridges comprise a black toner printing cartridge, a cyan toner printing cartridge, a magenta toner printing cartridge, and a yellow toner printing cartridge;

wherein said black toner printing cartridge is in a first position of said toner printer;

removing said black toner printing cartridge from said toner printer;

wherein said cyan toner printing cartridge is in a fourth position of said toner printer;

removing said cyan toner printing cartridge from said toner printer;

providing a light toner printing cartridge;

installing said cyan toner printing cartridge into said first position of said toner printer;

installing said light toner printing cartridge into said fourth position of said toner printer; and providing raster image processor (RIP) software for printing cartridge remapping; and wherein said providing of said light toner printing cartridge comprises: disassembling said removed black toner printing cartridge; emptying and cleaning said removed black toner printing cartridge, such that an empty printing cartridge is created; and filling said empty printing cartridge with a light toner.

10. The method of converting a printer to print with light toner of claim 9, wherein said light toner comprises light magenta toner or light cyan toner.

11. The method of converting a printer to print with light toner of claim 9, further comprising the steps:

printing a first layer not using said light toner printing cartridge, and then printing a second layer over said first layer;

wherein said second layer prints only using said light toner printing cartridge.

12. The method of converting a printer to print with light toner of claim 9, further comprising the step:

printing a layer using all four of said four toner printing cartridges.

13. The method of converting a printer to print with light toner of claim 9, wherein said printer is a LED toner printer.

14. The method of converting a printer to print with light toner of claim 9, wherein said four toner printing cartridges of said printer comprise four separate drums and four separate toner printing cartridges.

15. The method of converting a printer to print with light toner of claim 9, wherein said four toner printing cartridges of said printer comprise four separate toner printing cartridges and one single drum cartridge.

16. The method of converting a printer to print with light toner of claim 9, wherein said four toner printing cartridges of said printer comprise four combined toner and drum printing cartridges.

17. A method of converting a printer to print with clear fluorescent toner, comprising the steps:

providing a toner printer;

wherein said toner printer has four printing cartridges;

wherein said four printing cartridges comprise a black toner printing cartridge, a cyan toner printing cartridge, a magenta toner printing cartridge, and a yellow toner printing cartridge;

wherein said black toner printing cartridge is in a first position of said toner printer;

removing said black toner printing cartridge from said toner printer;

wherein said cyan toner printing cartridge is in a fourth position of said toner printer;

removing said cyan toner printing cartridge from said toner printer;

providing a clear fluorescent toner printing cartridge;

installing said cyan toner printing cartridge into said first position of said toner printer;

installing said clear fluorescent toner printing cartridge into said fourth position of said toner printer;

providing raster image processor (RIP) software for printing cartridge remapping; and wherein said clear fluorescent toner is only visible under an ultraviolet light.

18. The method of converting a printer to print with clear fluorescent toner of claim 17, further comprising the steps:

printing a first layer not using said clear toner printing cartridge and then printing a second layer over said first layer;

wherein said second layer prints only using said clear fluorescent toner printing cartridge.

19. The method of converting a printer to print with clear fluorescent toner of claim 17, wherein said printer is a LED toner printer.

20. The method of converting a printer to print with clear fluorescent toner of claim 17, wherein said four toner printing cartridges of said printer comprise four separate drums and four separate toner printing cartridges.

21. The method of converting a printer to print with clear fluorescent toner of claim 17, wherein said four toner printing cartridges of said printer comprise four separate toner printing cartridges and one single drum cartridge.

22. The method of converting a printer to print with clear fluorescent toner of claim 17, wherein said four toner printing cartridges of said printer comprise four combined toner and drum printing cartridges.

23. The method of converting a printer to print with clear fluorescent toner of claim 17, wherein said providing of said clear fluorescent toner printing cartridge comprises: disassembling said removed black toner printing cartridge; emptying and cleaning said removed black toner printing cartridge, such that an empty printing cartridge is created; and filling said empty printing cartridge with a clear fluorescent toner.

* * * * *